US008986916B2

(12) United States Patent
Yamashita et al.

(10) Patent No.: US 8,986,916 B2
(45) Date of Patent: Mar. 24, 2015

(54) YELLOW TONER AND COLOR IMAGE FORMING METHOD

(71) Applicants: Hiroshi Yamashita, Shizuoka (JP); Masana Shiba, Shizuoka (JP); Satoyuki Sekiguchi, Shizuoka (JP); Yukari Fukuda, Miyagi (JP); Daisuke Asahina, Shizuoka (JP); Rintaro Takahashi, Miyagi (JP); Tsuyoshi Sugimoto, Shizuoka (JP)

(72) Inventors: Hiroshi Yamashita, Shizuoka (JP); Masana Shiba, Shizuoka (JP); Satoyuki Sekiguchi, Shizuoka (JP); Yukari Fukuda, Miyagi (JP); Daisuke Asahina, Shizuoka (JP); Rintaro Takahashi, Miyagi (JP); Tsuyoshi Sugimoto, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 2 days.

(21) Appl. No.: 13/726,997

(22) Filed: Dec. 26, 2012

(65) Prior Publication Data

US 2013/0171554 A1 Jul. 4, 2013

(30) Foreign Application Priority Data

Dec. 28, 2011 (JP) ..... 2011-288853

(51) Int. Cl.
*G03G 13/08* (2006.01)
*G03G 9/09* (2006.01)

(52) U.S. Cl.
CPC ..... *G03G 9/0906* (2013.01)
USPC ..... 430/123.54; 430/108.2; 430/110.2; 430/123.5

(58) Field of Classification Search
USPC ..... 430/108.2, 110.2, 123.5, 123.54
See application file for complete search history.

(56) References Cited

U.S. PATENT DOCUMENTS

| | | | |
|---|---|---|---|
| 4,620,987 | A | 11/1986 | Yamashita et al. |
| 4,885,350 | A | 12/1989 | Yamashita et al. |
| 5,346,797 | A | 9/1994 | Kmiecik-Lawrynowicz et al. |
| 5,368,972 | A | 11/1994 | Yamashita et al. |
| 5,541,031 | A | 7/1996 | Yamashita et al. |
| 5,576,393 | A | 11/1996 | Yamashita et al. |
| 6,140,000 | A | 10/2000 | Yamashita |
| 6,329,115 | B1 | 12/2001 | Yamashita |
| 6,416,914 | B1 | 7/2002 | Nakamura et al. |
| 6,432,598 | B1 * | 8/2002 | Alexandrovich et al. .. 430/107.1 |
| 6,632,579 | B1 | 10/2003 | Yamashita |
| 7,214,461 | B2 | 5/2007 | Yamashita et al. |
| 2003/0077536 | A1 | 4/2003 | Yamashita et al. |
| 2003/0162112 | A1 | 8/2003 | Yamashita et al. |
| 2003/0219669 | A1 | 11/2003 | Yamashita et al. |
| 2005/0196692 | A1 | 9/2005 | Yamashita et al. |
| 2006/0068312 | A1 | 3/2006 | Yamashita et al. |

(Continued)

FOREIGN PATENT DOCUMENTS

| | | |
|---|---|---|
| JP | 63-282752 | 11/1988 |
| JP | 06-250439 | 9/1994 |

(Continued)

OTHER PUBLICATIONS

Diamond, "The Handbook of Imaging Materials," Marcel Dekker, NY, NY 1991.*

(Continued)

*Primary Examiner* — Peter Vajda
(74) *Attorney, Agent, or Firm* — Oblon, McClelland, Maier & Neustadt, L.L.P.

(57) ABSTRACT

A yellow toner including: a non-crystalline resin; C.I. Pigment Yellow 185; and a releasing agent, wherein the yellow toner has a glass transition temperature of more than 18° C. but less than 40° C.

1 Claim, 3 Drawing Sheets

(56) References Cited

U.S. PATENT DOCUMENTS

| | | | | |
|---|---|---|---|---|
| 2006/0177756 | A1 | 8/2006 | Sugimoto et al. | |
| 2006/0216628 | A1* | 9/2006 | Nakamura et al. | 430/110.2 |
| 2006/0292482 | A1 | 12/2006 | Yamashita et al. | |
| 2007/0015077 | A1 | 1/2007 | Yamashita et al. | |
| 2008/0070151 | A1 | 3/2008 | Sugimoto et al. | |
| 2008/0318148 | A1 | 12/2008 | Sugimoto et al. | |
| 2009/0092917 | A1 | 4/2009 | Sugimoto et al. | |
| 2009/0214973 | A1 | 8/2009 | Sugimoto et al. | |
| 2010/0035170 | A1 | 2/2010 | Sugimoto et al. | |
| 2011/0076607 | A1 | 3/2011 | Sugimoto et al. | |
| 2011/0212398 | A1* | 9/2011 | Hayashi et al. | 430/109.3 |
| 2011/0294058 | A1 | 12/2011 | Shiba et al. | |

FOREIGN PATENT DOCUMENTS

| | | |
|---|---|---|
| JP | 11-133665 | 5/1999 |
| JP | 2000-275907 | 10/2000 |
| JP | 2001-305797 | 11/2001 |
| JP | 2002-287400 | 10/2002 |
| JP | 2002-351143 | 12/2002 |
| JP | 2005-077776 | 3/2005 |

OTHER PUBLICATIONS

U.S. Appl. No. 08/165,101, filed Dec. 10, 1993, Yamashita, et al.

* cited by examiner

YELLOW TONER AND COLOR IMAGE FORMING METHOD

BACKGROUND OF THE INVENTION

1. Field of the Invention

The present invention relates to a yellow toner and a color image forming method.

2. Description of the Related Art

In recent years, demands have arisen on the market for toners which have various advantageous properties such as small particle diameters for forming high-quality images and improved low-temperature fixing ability for energy saving.

However, further smaller toner particles have been technically difficult to be produced by a conventional kneading-pulverizing method. In addition, the kneading-pulverizing method has produced problematic toner particles in their undefined shape, broad particle diameter distribution, and high fixing energy. On the other hand, the toner produced by the kneading-pulverizing method cracks at a site in which a releasing agent exists upon manufacturing, so that the resultant toner has a large amount of the releasing agent on their surface. As a result, a releasing effect can be easily exerted upon fixing, but toner becomes likely to adhere to a carrier, a photoconductor and a blade. The properties of such toners are not satisfactory in total.

In order to overcome the above-described problems the kneading-pulverizing method has, there is proposed a method for producing a toner by a polymerization method.

According to the polymerization method, toners are made easily to have a small particle diameter. Their particle diameter distribution is sharper than that of the toners obtained by the pulverizing method. Furthermore, a releasing agent can be embedded in the toner particles. For example, methods for producing a toner by an emulsification polymerization-aggregation method have been proposed (see, Japanese Patent Application Laid-Open (JP-A) Nos. 63-282752 and 06-250439).

Improved methods which have overcome a problem regarding use of surfactants in the emulsion polymerization-aggregation method have also been proposed (see, JP-A Nos. 2000-275907 and 2001-305797).

A dry toner having a practical sphericity of 0.90 to 1.00, using, as a binder, an elongated product of urethane-modified polyester for the purposes of improving toner in fluidity, low-temperature fixing ability and hot offset resistance has also been proposed (see JP-A No. 11-133665). Also, a dry toner having excellent fluidity and transferability as powder with a small particle diameter as well as being excellent in heat resistant storage stability, low-temperature fixing ability and hot offset resistance has been proposed (see, JP-A Nos. 2002-287400, 2002-351143, and 2005-77776). Methods for producing above-proposed toner disclosed in JP-A Nos. 11-133665, 2002-287400, 2002-351143, and 2005-77776 each include a step of increasing the molecular weight by polyaddition-reacting an isocyanate group-containing polyester prepolymer with an amine in an organic solvent and an aqueous medium, and a step of removing the organic solvent, for example, with heating.

However, the above conventional polymerized toner are produced in water, so that, for example, soap, particles, and water-soluble polymer are adhered on toner particles upon manufacturing, which deteriorates meltability of toner at fixing, adhesiveness of toner to each other, and adhesiveness of toner to paper. Therefore, excellent color property could not achieved on paper.

In particular, when a yellow toner image is located on an uppermost surface of paper, the yellow toner is required to have excellent color property. However, the conventional yellow toner produced by the polymerization method is problematic in poor color developing property on glossy paper which needs high color property, especially poor green-color developing property when superposed on a cyan toner image.

Accordingly, there is a need to provide a yellow toner which is excellent in color developing property on a recording medium, especially on glossy paper which needs high color property, as well as in green-color developing property when superposed on a cyan toner image.

The present invention aims to solve the above existing problems and achieve the following objects. Specifically, the present invention provides a yellow toner which is excellent in color developing property on a recording medium, especially on glossy paper which needs high color property, as well as in green-color developing property when superposed on a cyan toner image.

SUMMARY OF THE INVENTION

Means for solving the above problems are as follows.

A yellow toner of the present invention contains at least a non-crystalline resin, a crystalline resin, C.I. Pigment Yellow 185 and a releasing agent, and has a glass transition temperature of more than 18° C. but less than 40° C.

The present invention solves the various problems in the art and achieves the object mentioned above, and can provide a yellow toner which is excellent in color developing property on a recording medium, especially on glossy paper which needs high color property, as well as in green-color developing property when superposed on a cyan toner image.

Figure 1:
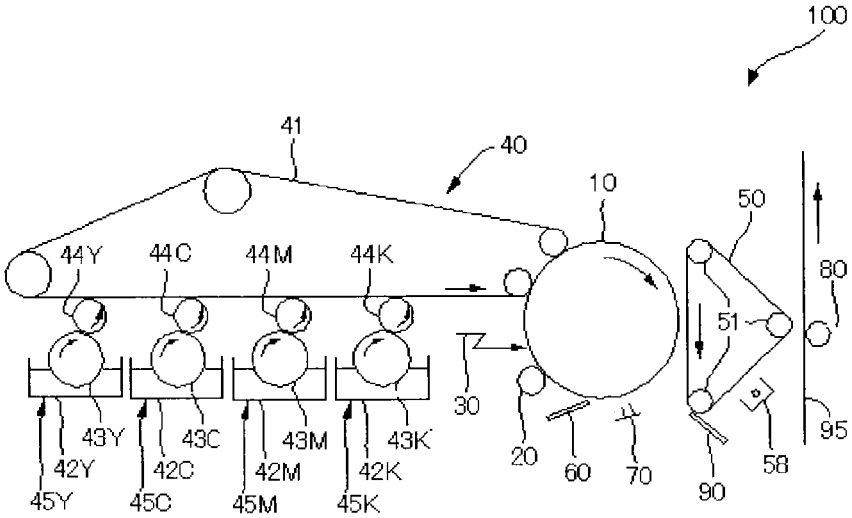
FIG. 1 is an explanatory, schematic view of one exemplary image forming apparatus used in a color image forming method according to the present invention.

DETAILED DESCRIPTION OF THE INVENTION (Yellow Toner)

A yellow toner of the present invention (hereinafter may be referred to as simply "toner") contains at least a non-crystalline resin, C.I. Pigment Yellow 185 and a releasing agent, preferably further contains a crystalline resin; and, if necessary, further contains other ingredients. The yellow toner has a glass transition temperature of more than 18° C. but less than 40° C.

The yellow toner preferably has a core-shell structure.

An image forming method in which a plurality of color images are superposed on top of another, followed by developing and being transferred to, for example, paper at one time via an intermediate transfer medium has been used in order to obtain a high-quality image.

A yellow toner is firstly developed in order to, when a superposed image is transferred, prevent another color toner from being reverse-transferred to a developing unit to thereby contaminate it. Thus, the yellow toner is on the uppermost surface of paper when the superposed image is transferred to the paper.

Therefore, transparency and color property of the yellow toner are important factors which control color property in the superposed image.

The present inventors have succeeded in allowing the yellow toner to be excellent in color developing property when disposed on the uppermost surface of paper by extremely lowering the glass transition temperature of the yellow toner.

Further, use of C.I. Pigment Yellow 185 can allow color property of the monochrome yellow image to fall within a predetermined color range even when the glass transition temperature of the yellow toner is extremely low, and can remarkably improve green-color reproducibility even when a cyan toner image is present below a yellow image.

In addition, inclusion of the crystalline resin can provide excellent low temperature fixing ability and allow the toner to spread more widely over the image, resulting in developing a more desired color.

The yellow toner having the core-shell structure can provide excellent heat resistance storage stability. Especially, when the yellow toner contains the crystalline resin, the yellow toner having a desired color property as well as being excellent in low temperature fixing ability and heat resistance storage stability can be obtained because some deterioration in storability resulting from inclusion of the crystalline resin can be suppressed.

When an image is formed with only yellow toner on a recording medium such as glossy paper at a toner adhesion amount of 0.30 mg/cm$^2$, the resultant image having L* of 87 to 91, a* of −15 to −5, and b* of 90 to 110 in CIE Lab color space is considered as good in color developing property. The resultant image having L* of 87 to 91, a* of −15 to −9, and b* of 95 to 110 in CIE Lab color space is considered as better in color developing property.

Example of the glossy paper includes POD GLOSSCOAT (product of Oji paper Co., Ltd., basis weight: 158 g/m$^2$, paper thickness: 175 μm, brightness: 80% or more).

The CIE Lab can be measured using X-RITE 938 (product of X-rite Inc.), for example, under the following conditions.

Light source: D50

Photometry: light reception 0°, lighting 45°

Colorimetry: view angle 2°

Measuring 10 sheets of glossy paper laminated with each other

In the present invention, when a green image is formed by forming an image with a cyan toner on a recording medium such as glossy paper at a toner adhesion amount of 0.30 mg/cm$^2$ and by forming an image with the yellow toner at a toner adhesion amount of 0.30 mg/cm$^2$ on the image formed with the cyan toner, the resultant green image having L* of 47 to 51, a* of −71 or less (preferably −71 to −80), and b* of 20 to 30 in CIE Lab color space is considered as good in green-color reproducibility.

<Non-Crystalline Resin>

The non-crystalline resin is not particularly limited and may be appropriately selected depending on the intended purpose. Examples thereof include polyester resins; polymers of styrene or substitution products thereof such as polystyrene resins, poly-p-chlorostyrenes and polyvinyltoluenes; styrene-based copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; polymethyl methacrylate resins; polybutyl methacrylate resins; polyvinyl chloride resins; polyvinyl acetate resins; polyethylene resins; polypropylene resins; epoxy resins; epoxy polyol resins; polyurethane resins; polyamide resins; polyvinyl butyrals; polyacrylic acid resins; rosins; modified rosins; terpene resins; aliphatic or alicyclic hydrocarbon resins; and aromatic petroleum resins.

These may be used alone or in combination.

Among them, preferred are polyester resins (non-crystalline polyester resins) from the viewpoint of being capable of obtaining a high-gloss image and being excellent in low temperature fixing ability and heat resistance storage stability.

—Polyester Resin (Non-Crystalline Polyester Resin)—

The polyester resin (non-crystalline polyester resin) is not particularly limited and may be appropriately selected depending on the intended purpose. For example, the polyester resin (non-crystalline polyester resin) can be produced by polycondensating alcohols with carboxylic acids.

Examples of the alcohols include glycols such as ethyleneglycol, diethyleneglycol, triethyleneglycol and propyleneglycol; etherified bisphenols such as 1,4-bis(hydroxymethyl)cyclohexane and bisphenol A; and other divalent alcohol monomers.

Examples of the carboxylic acids include a divalent organic acid monomer such as adipic acid, maleic acid, fumaric acid, phthalic acid, isophthalic acid, terephthalic acid, succinic acid and malonic acid.

The non-crystalline polyester resin preferably contains a cross-linking component. Examples of the cross-linking component include a trihydric or higher alcohol and a trivalent or higher carboxylic acid.

Example of the trihydric or higher alcohol includes glycerin.

Examples of the trivalent or higher carboxylic acid include a trihydric or higher polycarboxylic acid monomer such as trimellitic acid, 1,2,4-cyclohexane tricarboxylic acid, 1,2,4-naphthalene tricarboxylic acid, 1,2,5-hexane tricarboxylic acid, 1,3-dicarboxyl-2-methylene carboxypropane, and 1,2,7,8-octane tetracarboxylic acid.

A glass transition temperature of the non-crystalline resin is not particularly limited and may be appropriately selected depending on the intended purpose, but preferably more than 18° C. but less than 40° C., more preferably 20° C. to 35° C. When the glass transition temperature is 18° C. or less, the resultant toner may be poor in heat resistance storage stability and durability to stress such as stirring in a developing device. When the glass transition temperature is 40° C. or more, the resultant toner may be increased in viscoelasticity during melting, which may deteriorate low-temperature fixing ability.

A weight average molecular weight of the non-crystalline resin is not particularly limited and may be appropriately selected depending on the intended purpose, but preferably 10,000 to 100,000, more preferably 15,000 to 45,000. When the weight average molecular weight is less than 10,000, hot offset occurs and thus a fixing temperature range cannot be broadened in some cases. When the weight average molecular weight is more than 100,000, the non-crystalline resin (for example, polyester resin) has too high melt viscosity, which may prevent low temperature fixing ability from being exerted.

An amount of the non-crystalline resin contained in the yellow toner is not particularly limited and may be appropriately selected depending on the intended purpose, but preferably 50 parts by mass to 95 parts by mass, more preferably 60 parts by mass to 90 parts by mass relative to 100 parts by mass of the yellow toner. When it is less than 50 parts by mass, the C.I. Pigment Yellow 185 and the releasing agent are degraded in dispersibility in the toner, easily causing image fogging and image failure. When it is more than 95 parts by mass, the formed toner may be degraded in low-temperature fixing ability since the amount of the crystalline resin becomes small. When it falls within the above more preferred range, the formed toner is excellent in all of image quality, heat resistance storage stability and low temperature fixing ability, which is advantageous.

A molecular structure of the non-crystalline polyester resin may be confirmed, for example, by NMR measurement in a solution or as a solid, as well as X-ray diffraction, GC/MS, LC/MS, or IR. Briefly, in the infrared absorption spectrum, those having no absorption at wavelengths of 965 $cm^{-1}$±10 $cm^{-1}$ and 990 $cm^{-1}$±10 $cm^{-1}$, which is based on an out-of-plane bending vibration (δCH) of an olefin, is identified as the non-crystalline resin.

<Crystalline Resin>

The crystalline resin has high crystallinity and thus exhibits such a hot melt property that the viscosity is rapidly decreased in the vicinity of a temperature at which fixing is initiated. The use of such crystalline resin in the yellow toner provides a toner having both excellent heat resistant storage stability and low-temperature fixing ability, since the crystalline resin exhibits excellent heat resistant storage stability due to its crystallinity immediately before melting is initiated and is rapidly decreased in viscosity (sharp melt property) for fixing at a temperature at which melting is initiated. In addition, the above resultant toner has a suitable difference between the lower limit fixing temperature and the temperature at which hot offset occurs (i.e., a mold release range).

The crystalline resin is not particularly limited and may be appropriately selected depending on the intended purpose, so long as it is a resin having crystallinity. Examples thereof include polyester resin, polyurethane resin, polyurea resin, polyamide resin, polyether resin, vinyl resin, and modified crystalline resin. These may be used alone or in combination. Among them, preferred is polyester resin (crystalline polyester resin) from the viewpoint of compatibility of a non-crystalline component with the polyester resin when heated because polyester resin is suitable for the non-crystalline component in the yellow toner.

—Polyester Resin (Crystalline Polyester Resin)—

The polyester resin (crystalline polyester resin) can be produced from, for example, a polyhydric alcohol component and a polyhydric carboxylic acid component such as a polyhydric carboxylic acid, a polyhydric carboxylic acid anhydride and a polyhydric carboxylic acid ester.

The polyhydric alcohol component is not particularly limited and may be appropriately selected depending on the intended purpose. Examples thereof include diols and trihydric or higher alcohols.

Examples of the diols include saturated aliphatic diols. Examples of the saturated aliphatic diols include linear saturated aliphatic diols and branched saturated aliphatic diols. Among them, preferred are linear saturated aliphatic diols, and more preferred are C4-C12 linear saturated aliphatic diols. When the branched saturated aliphatic diols are used, the resultant crystalline polyester resin may decrease in crystallinity and thus decrease in melting point. Also, in a case that the number of carbon atoms contained in the main chain thereof is less than 4, when such diols are polycondensated with an aromatic dicarboxylic acid, the resultant crystalline polyester resin may increase in melting temperature to prevent low temperature fixing. Whereas, such diols that have carbon atoms exceeding 12 in the main chain thereof are difficult to obtain practically.

Examples of the saturated aliphatic diols include ethylene glycol, 1,3-propanediol, 1,4-butanediol, 1,5-pentandiol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,14-eicosanediol. Among them, preferred are 1,4-butanediol, 1,6-hexanediol, 1,8-octanediol, 1,10-decanediol and 1,12-dodecanediol, since the resultant crystalline polyester resin has high crystallinity and excellent sharp melt property.

Examples of the trihydric or higher alcohols include glycerin, trimethylolethane, trimethylolpropane and pentaerythritol.

These may be used alone or in combination.

The polycarboxylic acid component is not particularly limited and may be appropriately selected depending on the intended purpose. Examples thereof include divalent carboxylic acids and trivalent or higher carboxylic acids.

Examples of the divalent carboxylic acids include saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid; aromatic dicarboxylic acids such as dibasic acids, e.g., phthalic acid, isophthalic acid, terephthalic acid and naphthalene-2,6-dicarboxylic acid, malonic acid, mesaconic acid; as well as anhydrides or lower alkyl esters thereof (for example, C1-C4 alkylester).

Examples of the trivalent or higher carboxylic acids include trimellitic acid and 1,2,4-naphthalenetricarboxylic acid; and anhydrides or lower alkyl esters thereof (for example, C1-C4 alkylester).

The polycarboxylic acid component may further contain a dicarboxylic acid component having a sulfonate group, in addition to the saturated aliphatic dicarboxylic acid and/or the aromatic dicarboxylic acid. Moreover, it may further contain a dicarboxylic acid component having a double bond, in addition to the saturated aliphatic dicarboxylic acid and/or the aromatic dicarboxylic acid.

These may be used alone or in combination.

The crystalline polyester resin preferably has a constituent unit derived from the saturated aliphatic dicarboxylic acid and a constituent unit derived from the saturated aliphatic diol from the viewpoint of having high crystallinity and being excellent in sharp melt property, leading to excellent low temperature fixing ability.

A melting point of the crystalline resin is not particularly limited and may be appropriately selected depending on the intended purpose. It is preferably higher than 60° C. but lower than 80° C. When the melting point thereof is 60° C. or less, the crystalline resin easily melts at low temperatures, potentially degrading the toner in heat resistance storage stability. Whereas when it is 80° C. or higher, the crystalline resin does not sufficiently melt with heating upon fixing of the resin, potentially degrading the toner in low temperature fixing ability.

A molecular weight of the crystalline resin is not particularly limited and may be appropriately selected depending on the intended purpose. The crystalline resin having a sharp molecular weight distribution and a low molecular weight is excellent in low temperature fixing ability. Also, the crystalline resin containing a large amount of low-molecular weight components is degraded in heat resistance storage stability. From these viewpoints, through GPC (gel permeation chromatography) measurement, soluble matter of the crystalline resin in o-dichlorobenzene preferably has a weight average molecular weight (Mw) of 3,000 to 30,000, a number average molecular weight (Mn) of 1,000 to 10,000, and an Mw/Mn of 1.0 to 10.

More preferably, the weight average molecular weight (Mw) thereof is 5,000 to 15,000, the number average molecular weight (Mn) thereof is 2,000 to 10,000, and the Mw/Mn thereof is 1.0 to 5.0.

An amount of the crystalline resin contained is not particularly limited and may be appropriately selected depending on the intended purpose. It is preferably 2 parts by mass to 22.5 parts by mass, more preferably 2 parts by mass to 20 parts by mass, still more preferably 5 parts by mass to 15 parts by mass, particularly preferably 7.5 parts by mass to 15 parts by mass relative to 100 parts by mass of the yellow toner. When it is less than 2 parts by mass, the crystalline resin cannot sufficiently exhibit its sharp melt property to thereby potentially degrade the toner in low temperature fixing ability. When it is more than 20 parts by mass, the resultant toner may be degraded in heat resistance storage stability and may easily cause image fogging. When the amount of the crystalline resin falls within the above particularly preferred range, the resultant toner is excellent in all of image quality, high heat resistance storage stability and low temperature fixing ability, which is advantageous.

It is preferred that the non-crystalline resin and the crystalline resin are incompatible with each other before heating, and the non-crystalline resin and the crystalline resin are compatible with each other after heating. When they are compatible with each other before heating, the toner may be deteriorated in heat resistance storage stability. When they are incompatible with each other after heating, the toner may be deteriorated in low temperature fixing ability.

Whether they are compatible with each other or not can be determined as follows. At first, one material is dissolved in an organic solvent at a concentration of 50% by mass to thereby obtain a solution. Next, a separate solution in which other material is dissolved in the organic solvent at a concentration of 50% by mass is added thereto, followed by visual observation. If the above-mentioned two solutions separate into two layers, they are considered as incompatible with each other. In contrast, when the two solutions do not separate into two layers, they are considered as compatible with each other. When the crystalline resin cannot be dissolved in the organic solvent, a cross-section of the resultant toner is observed. Based on presence or absence of domains of the crystalline resin, whether they are compatible with each other or not can be determined.

A molecular structure of the crystalline resin may be confirmed, for example, by NMR measurement in a solution or as a solid, as well as X-ray diffraction, GC/MS, LC/MS, or IR. Briefly, in the infrared absorption spectrum, those having absorption at wavelengths of 965 $cm^{-1}$±10 $cm^{-1}$ or 990 $cm^{-1}$±10 $cm^{-1}$, which is based on an out-of-plane bending vibration (SCH) of an olefin, is identified as the crystalline resin.

<C.I. Pigment Yellow 185>

The C.I. Pigment Yellow 185 is an isoindolin-based pigment represented by the following Structural Formula (1).

(1)

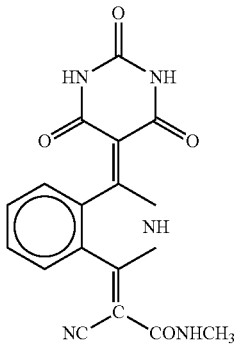

The C.I. Pigment Yellow 185 may be commercial products. Example thereof includes those available from BASF Japan Ltd.

When the yellow toner is produced with a chemical toner method, the C.I. Pigment Yellow 185 is preferably subjected to hydrophobization treatment or polarity adjustment for that of an aqueous phase because the C.I. Pigment Yellow 185 is incorporated into the toner upon contacting with water.

Examples of the hydrophobization treatment include a surface treatment with a silane coupling agent and an adsorptive treatment with a long-chain alkyl organic compound having a hydrophobic group.

An amount of the C.I. Pigment Yellow 185 contained in the yellow toner is not particularly limited and may be appropriately selected depending on the intended purpose, but is preferably 2.0 parts by mass to 15.0 parts by mass, more preferably 4.0 parts by mass to 10.0 parts by mass, particularly preferably 4.0 parts by mass to 7.5 parts by mass relative to 100 parts by mass of the yellow toner. When the amount is less than 2.0 parts by mass, a degree of coloration may be low. When the amount is more than 15.0 parts by mass, fixing property may be prevented. In contrast, when the amount of the C.I. Pigment Yellow 185 falls within the above particularly preferred range, the resultant yellow toner is advantageous in that properties other than color property (for example, fixing ability and charging ability) are excellent.

The yellow toner may contain pigments other than the C.I. Pigment Yellow 185 (other pigments). A mass ratio of the C.I. Pigment Yellow 185 to the other pigments (C.I. Pigment Yellow 185: other pigments) is not particularly limited and may be appropriately selected depending on the intended purpose, but is preferably 50:50 to 99:1, more preferably 75:25 to 99:1. When the C.I. Pigment Yellow 185 is less than 50% by mass in the mass ratio, an intended color range cannot be obtained in some cases. The mass ratio within the above more preferred range is advantageous in excellent green-color reproducibility.

<Releasing Agent>

The releasing agent is not particularly limited and may be appropriately selected from known releasing agents. Examples thereof include natural waxes and synthetic hydrocarbon waxes.

Examples of the natural waxes include vegetable waxes such as carnauba wax, cotton wax, Japan wax and rice wax; animal waxes such as bees wax and lanolin; mineral waxes such as ozokelite and ceresine; and petroleum waxes such as paraffin waxes, microcrystalline waxes and petrolatum.

Examples of the synthetic hydrocarbon waxes include Fischer-Tropsch waxes, polyethylene and polypropylene.

Further examples include fatty acid amide-based compounds such as 12-hydroxystearic acid amide, stearic amide, phthalic anhydride imide and chlorinated hydrocarbons; low-molecular weight crystalline polymer resins such as acrylic homopolymers (e.g., poly-n-stearyl methacrylate and poly-n-lauryl methacrylate) or acrylic copolymers (e.g., n-stearyl acrylate-ethyl methacrylate copolymers); and crystalline polymers having a long alkyl group as a side chain.

Among them, preferred are natural waxes, more preferred are vegetable waxes, and particularly preferred is carnauba wax.

A melting point of the releasing agent is not particularly limited and may be appropriately selected depending on the intended purpose, but is preferably 50° C. or higher but lower than 90° C. When the melting point of the releasing agent is lower than 50° C., the releasing agent easily melts at low temperatures and thus the resultant toner may be degraded in heat resistant storage stability. Whereas when the melting point of the releasing agent is 90° C. or higher, the releasing agent insufficiently melts with heating upon fixing and thus the toner cannot exhibit satisfactory offset resistance in some cases.

An amount of the releasing agent contained in the yellow toner is not particularly limited and may be appropriately selected depending on the intended purpose. It is preferably 2 parts by mass to 10 parts by mass, more preferably 3 parts by mass to 8 parts by mass relative to 100 parts by mass of the yellow toner. When it is less than 2 parts by mass, the resultant toner may be degraded in low temperature fixing ability and hot offset resistance upon fixing. Whereas when it is more than 10 parts by mass, the resultant toner may be degraded in heat resistant storage stability and easily cause image fogging. When the amount of the releasing agent contained in the toner falls within the above more preferred range, the resultant toner is advantageously improved in high-quality image formation and fixing stability.

<Other Ingredients>

The other ingredients are not particularly limited and may be appropriately selected depending on the intended purpose. Examples thereof include pigments other than the C.I. Pigment Yellow 185, charge controlling agents, inorganic particles, flowability improving agents, cleanability improving agents, magnetic materials and metallic soap.

<Core-Shell Structure>

The core-shell structure is a structure including a core and a shell.

Example of the core-shell structure includes a structure in which an acryl resin particles serving as a shell are adhered onto each surface of toner particles which is formed with, as a core, a toner material containing the non-crystalline resin, the C.I. Pigment Yellow 185 and the releasing agent, and preferably further containing the crystalline resin.

The core-shell structure can be formed with, for example, a below-mentioned yellow toner producing method.

—Core—

The core preferably contains the non-crystalline resin, the crystalline resin, the C.I. Pigment Yellow 185 and the releasing agent.

—Shell—

The shell is not particularly limited and may be appropriately selected depending on the intended purpose, but is preferably a shell formed of the acryl resin particles.

—Acryl Resin Particles—

The acryl resin particles are not particularly limited and may be appropriately selected depending on the intended purpose. The acryl resin particles are preferably a cross-linked polymer, more preferably a copolymer with a monomer having at least two unsaturated groups, in order to allow the acryl resin particles to be fixed onto a surface of an emulsified droplet, rather than being dissolved, when the acryl resin particles adhere to the emulsified droplet.

The monomer having at least two unsaturated groups is not particularly limited and may be appropriately selected depending on the intended purpose. Examples thereof include a sodium salt of sulfate ester of methacrylic acid-ethylene oxide adduct (ELEMINOL RS-30: product of Sanyo Chemical Industries, Ltd.), divinylbenzene, 1,6-hexanediol diacrylate, and ethyleneglycol dimethacrylate.

The acryl resin particles usually contain no styrene as a component.

A glass transition temperature (Tg) of the acryl resin particles is not particularly limited and may be appropriately selected depending on the intended purpose, but is preferably higher than 50° C. but lower than 115° C., more preferably higher than 50° C. but lower than 100° C., particularly preferably 70° C. to 90° C. When the glass transition temperature (Tg) is 50° C. or lower, the resultant toner may deteriorated in storage stability, which may cause toner blocking during storage and in a developing device. When the glass transition temperature (Tg) is 115° C. or higher, the resin particles may impair adhesion with fixing paper, which may elevate the lower limit fixing temperature.

The glass transition temperature of the acryl resin particles may be referred to as the glass transition temperature of the shell.

A volume average particle diameter of the acryl resin particles is not particularly limited and may be appropriately selected depending on the intended purpose, but is preferably 10 nm to 500 nm, more preferably 30 nm to 400 nm, particularly preferably 30 nm to 60 nm. When the acryl resin particles having such volume average particle diameter are adhered to a surface of the core, non-electrostatic adhesion of the toner particles can be reduced due to spacer effect. Further, even when a strong temporal mechanical stress is applied such as in a high-speed machine, an increase in non-electrostatic adhesion resulting from embedding of the acryl resin particles in the toner surface can be suppressed, and thus satisfactory transfer efficiency can be maintained for a long period of time. These effects are very effective especially when an image forming process includes two transfer steps of a primary transfer step and a secondary transfer step in an intermediate transfer manner, and particularly effective in a relatively high-speed image forming process (transfer linear velocity: 300 mm/sec to 1,000 mm/sec, transfer time in a secondary nip portion: 0.5 msec to 20 msec).

When the volume average particle diameter is smaller than 10 nm, a sufficient spacer effect cannot be achieved, which cannot reduce non-electrostatic adhesion of the toner particles. Further, the acryl resin particles or an external additive is likely to be embedded in a surface of the toner when a strong temporal mechanical stress is applied thereto such as in a high-speed machine, which may prevent from maintaining satisfactory transfer efficiency for a long period of time. When the volume average particle diameter is larger than 500 nm, the resultant toner may be deteriorated in fluidity, resulting in ununiform transferability.

The volume average particle diameter can be measured with LA-920 (product of HORIBA Co.)

In general, when the toner particles are filled into a developing device, resin particles on each surface of the toner particles are embedded inside the toner particles or moved into concaves on the surface of the toner particles mainly through mechanical stress applied thereto in the developing device, which eliminates an adhesion reduction effect of the toner. In addition, the external additive is also embedded inside the toner particles through similar stress to those described above, which increases toner adhesion.

By contrast, in the toner having the core-shell structure in which the shell is formed of the acryl resin particles, the acryl resin particles have relatively large diameter, so that they are less likely to be embedded inside the toner particles. In particular, the acryl resin particles are preferably particles of a cross-linked resin containing an acrylic acid ester polymer or a methacrylic acid ester polymer. The acryl resin particles are suitable for maintaining the above adhesion because such acryl resin particles are relatively hard due to cross-linking, so that they are not deformed on each surface of the toner particles even when mechanical stress is applied thereto in the developing device and can maintain spacer effect, to thereby prevent the external additive from being embedded inside the toner particles.

A molecular weight of the shell is not particularly limited and may be appropriately selected depending on the intended purpose. However, through GPC measurement, soluble matter of the shell in tetrahydrofuran has preferably a weight average molecular weight (Mw) of 10,000 to 1,000,000. When the Mw of the shell is less than 10,000, the shell is increased in solubility in an organic solvent (for example, ethyl acetate), which may make it difficult to allow the shell material (for example, acryl resin particles) to adhere onto a toner surface. When the Mw of the shell is more than 1,000,000, the shell is increased in resin viscosity, which may deteriorate fixing ability.

An amount of the shell contained is not particularly limited and may be appropriately selected depending on the intended purpose, but is preferably 0.5 parts by mass to 5 parts by mass, more preferably 1 part by mass to 4 parts by mass relative to 100 parts by mass of the yellow toner. When the amount is less than 0.5 parts by mass, a sufficient spacer effect cannot be obtained, which may prevent from reducing non-electrostatic adhesion. When the amount is more than 5 parts by mass, the resultant toner may be deteriorated in flowability, resulting in ununiform transferability. In addition, the shell material (for example, acryl resin particles) cannot be sufficiently fixed on the resultant toner particles and thus is easily exfoliated therefrom to thereby adhere to, for example, a carrier or a photoconductor, which may contaminate, for example, the photoconductor.

The shell and the non-crystalline resin, and the shell and the crystalline resin are preferably incompatible with each other. When the shell is compatible with the non-crystalline resin or the crystalline resin, the shell cannot remain on the toner surface, which may deteriorate heat resistance storage stability.

The yellow toner can be produced with a pigment dispersion (masterbatch). The pigment dispersion containing the non-crystalline resin and the C.I. Pigment Yellow 185 which is contained in the pigment dispersion in an amount of 30 parts by mass to 70 parts by mass relative to 100 parts by mass of the solid content of the pigment dispersion is preferred from the viewpoint of being excellent in dispersibility of the pigment in the toner.

The pigment dispersion containing 1 part by mass to 30 parts by mass of the releasing agent relative to 100 parts by mass of the solid content of the pigment dispersion is preferred in that it allows the pigment to be wetted with the resin in the masterbatch and assists in the dispersion of the pigment.

The pigment dispersion can be prepared by, under high shearing force, mixing and kneading the C.I. Pigment Yellow 185 with the resin for use in the masterbatch, and if necessary, further with the releasing agent. An organic solvent may be used for promoting interactions between the C.I. Pigment Yellow 185 and the resin. In this mixing and kneading, for example, a high-shearing disperser (e.g., a three-roll mill) is preferably used.

The resin for use in the masterbatch is not particularly limited and may be appropriately selected depending on the intended purpose. Example thereof includes the non-crystalline resin.

The yellow toner has preferably L* of 87 to 91, a* of −15 to −5, and b* of 90 to 110, more preferably L* of 87 to 91, a* of −15 to −9, and b* of 95 to 110 in CIE Lab color space from the viewpoint of being capable of obtaining an image having wide color reproducibility when the image was formed with only yellow toner on glossy paper at a toner adhesion amount of 0.30 mg/cm$^2$.

Example of the glossy paper includes POD GLOSSCOAT (product of Oji paper Co., Ltd., basis weight: 158 g/m$^2$, paper thickness: 175 μm, brightness: 80% or more).

The CIE Lab can be measured with X-RITE 938 (product of X-rite Inc.), for example, under the following conditions.

Light source: D50

Photometry: light reception 0°, lighting 45°

Colorimetry: view angle 2°

Measuring 10 sheets of glossy paper laminated with each other

A volume average particle diameter of the yellow toner is not particularly limited and may be appropriately selected depending on the intended purpose, but is preferably 1 μm to 6 μm, more preferably 2 μm to 5 μm. When the volume average particle diameter is less than 1 μm, toner dust is likely to be generated in the primary transfer and the secondary transfer. When the volume average particle diameter is more than 6 μm, the dot reproducibility is unsatisfactory and the granularity of a halftone part is also deteriorated, possibly failing to obtain a high-definition image.

A glass transition temperature of the yellow toner is higher than 18° C. but lower than 40° C., preferably 20° C. to 38° C., more preferably 26° C. to 35° C., particularly preferably 30° C. to 33° C.

A method for measuring a melting point and a glass transition temperature used herein now will be explained.

<Method for Measuring Melting Point and Glass Transition Temperature (Tg)>

The melting point and the glass transition temperature can be measured with, for example, a DSC (differential scanning calorimeter) system ("Q-200", product of TA Instruments. Japan.)

Specifically, the melting point and the glass transition temperature of a measurement sample can be measured following the below-described procedure.

First, about 5.0 mg of the measurement sample is added to an aluminum sample container. The sample container is placed on a holder unit and set in an electric furnace. Next, in a nitrogen atmosphere, the sample container is heated from 0° C. to 150° C. at a temperature increasing rate of 10° C./min. In this process, the DSC curve of the sample is measured with the differential scanning calorimeter ("Q-200", product by TA Instruments. Japan.).

Based on the obtained DSC curve, the melting point and the glass transition temperature of the measurement sample can be determined with the analysis program of the Q-200 system. Notably, the endothermic peak top temperature is considered as the melting point.

<Yellow Toner Producing Method>

The yellow toner producing method is not particularly limited and may be appropriately selected depending on the intended purpose. For example, the yellow toner is produced by a method which includes a toner material phase preparing step, an aqueous medium phase preparing step, an emulsion or dispersion liquid preparing step, an organic solvent removing step, and a heating step; and if necessary, further includes other steps.

—Toner Material Phase Preparing Step—

The toner material phase preparing step is not particularly limited and may be appropriately selected depending on the intended purpose, so long as it is a step in which the toner material containing the non-crystalline resin or a non-crystalline resin precursor, the crystalline resin, the C.I. Pigment Yellow 185 and the releasing agent are dissolved or dispersed in an organic solvent to thereby prepare a solution or dispersion liquid of the toner material (toner material phase).

The non-crystalline resin precursor is not particularly limited and may be appropriately selected depending on the intended purpose, so long as it can convert into the non-crystalline resin in the toner. Examples thereof include an active hydrogen group-containing compound and a polymer reactive with the active hydrogen group-containing compound (prepolymer). By containing in the toner material the active hydrogen group-containing compound and the polymer reactive with the active hydrogen group-containing compound (prepolymer), the resultant toner is increased in mechanical strength, and embedding of the acryl resin particles and external additives can be suppressed. When the active hydrogen group-containing compound has a cationic polarity, it can electrostatically attract the acryl resin particles. Further, the fluidity of the toner during the heat fixation can be regulated, and, consequently, the fixing temperature range can be broadened.

The active hydrogen group-containing compound is not particularly limited and may be appropriately selected depending on the intended purpose. Example thereof includes an amine compound. The amine compound is not particularly limited and may be appropriately selected depending on the intended purpose. Example thereof includes a ketimine compound.

The polymer reactive with the active hydrogen group-containing compound (prepolymer) is not particularly limited and may be appropriately selected depending on the intended purpose. Example thereof includes an isocyanate group-containing polyester resin.

The organic solvent is not particularly limited and may be appropriately selected depending on the intended purpose. It is preferably an organic solvent having a boiling point of lower than 150° C. since such organic solvent can easily be removed.

Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. Among them, preferred are ethyl acetate, toluene, xylene, benzene, methylene chloride, 1,2-dichloroethane, chloroform and carbon tetrachloride, and more preferred is ethyl acetate.

These solvents may be used alone or in combination.

The amount of the organic solvent used is not particularly limited and may be appropriately selected depending on the intended purpose, but is preferably 40 parts by mass to 300 parts by mass, more preferably 60 parts by mass to 140 parts by mass, particularly preferably 80 parts by mass to 120 parts by mass relative to 100 parts by mass of the toner material.

Notably, among the toner material, components other than the non-crystalline resin precursor may be added to the aqueous medium in the aqueous medium phase preparing step described below, or may be added to the aqueous medium together with the solution or dispersion liquid of the toner material upon mixing the solution or dispersion liquid with the aqueous medium.

—Aqueous Medium Phase Preparing Step—

The aqueous medium phase preparing step is not particularly limited and may be appropriately selected depending on the intended purpose, so long as it is a step of preparing an aqueous medium phase in which styrene/acryl resin particles and acryl resin particles are dispersed in an aqueous medium.

The aqueous medium is not particularly limited and may be appropriately selected depending on the intended purpose. Examples thereof include water, water-miscible solvents, and mixtures thereof. Among them, water is particularly preferred.

The water-miscible solvent is not particularly limited and may be appropriately selected depending on the intended purpose, so long as it is miscible with water. Examples thereof include alcohols, dimethylformamide, tetrahydrofuran, cellosolves and lower ketones.

Examples of the alcohols include methanol, isopropanol and ethylene glycol.

Examples of the lower ketones include acetone and methyl ethyl ketone.

These may be used alone or in combination.

The aqueous medium phase is prepared by, for example, dispersing the styrene/acryl resin particles in the aqueous medium in the presence of anionic surfactant.

An amount of the anionic surfactant and the styrene/acryl resin particles added to the aqueous medium is not particularly limited and may be appropriately selected depending on the intended purpose. For example, it is preferably 0.5% by mass to 10% by mass relative to that of the aqueous medium.

Subsequently, the acryl resin particles are added to the aqueous medium. When the acryl resin particles may be aggregated with the anionic surfactant, the aqueous medium is preferably previously dispersed with a high-speed shear disperser before emulsifying.

The anionic surfactant is not particularly limited and may be appropriately selected depending on the intended purpose. Examples thereof include fatty acid salts, alkyl sulfate ester salts, alkylaryl sulfonates, alkyldiarylether disulfonates, dialkyl sulfosuccinates, alkyl phosphates, naphthalene-sulfonic acid-formalin condensates, polyoxyethylene alkylphosphate ester salts, and glycerol borate fatty acid esters.

The styrene/acryl resin particles are not particularly limited and may be appropriately selected depending on the intended purpose, so long as they are different from the acryl resin particles, and are resin particles containing styrene as a component. A volume average particle diameter thereof is preferably 5 nm to 50 nm. The styrene/acryl resin particles have the volume average particle diameter smaller than that of the acryl resin particles.

The acryl resin particles can preferably form aggregates in the aqueous medium containing the anionic surfactant. In the yellow toner producing method, when the acryl resin particles are added to the aqueous medium, it is not preferred that each of the acryl resin particles is present stably and independently without adhering onto liquid droplets of the toner material. Because the acryl resin particles can form aggregates in the aqueous medium containing the anionic surfactant, the acryl resin particles which are present in the aqueous medium phase during or after emulsifying or dispersing can move onto the surface of the liquid droplet of the toner material and can easily adhere onto the surface of the liquid droplet of the toner material. That is, the acryl resin particles are generally unstable thereby forming aggregates in the aqueous medium containing the anionic surfactant. However, when the liquid droplets of the toner material are present, and there is a strong attraction force between the acryl resin particles and the liquid droplets of the toner material, the acryl resin particles form a complex together with the liquid droplets of the toner material.

—Emulsion or Dispersion Liquid Preparing Step—

The emulsion or dispersion liquid preparing step is not particularly limited and may be appropriately selected depending on the intended purpose, so long as it is a step of emulsifying or dispersing a mixture of the solution or dispersion liquid of the toner material (toner material phase) and the aqueous medium phase to thereby prepare an emulsion or dispersion liquid.

A method for emulsifying or dispersing is not particularly limited and may be appropriately selected depending on the intended purpose. For example, known dispersers may be used. Examples of the dispersers include low-speed shear dispersers and high-speed shear dispersers. In the yellow toner producing method, during the emulsification and/or dispersion, the active hydrogen group-containing compound and the polymer reactive with the active hydrogen group-containing compound are subjected to elongation reaction or cross-linking reaction, to thereby form an adhesive base material. The acryl resin particles may be added into the aqueous medium during or after emulsification. The acryl resin particles may be added thereinto while dispersing with the high-speed shear disperser or while dispersing with the low-speed shear disperser after emulsifying with the high-speed shear disperser, depending on an adhesion and a state of fixation of the acryl resin particles to the toner.

—Organic Solvent Removing Step—

The organic solvent removing step is not particularly limited and may be appropriately selected depending on the intended purpose, so long as it is a step of removing the organic solvent from the emulsion or dispersion liquid to thereby obtain desolventized slurry.

Examples thereof include (1) a method in which an entire system is gradually heated to thereby completely evaporate off the organic solvent contained in oil droplets in the emulsion or dispersion liquid and (2) a method in which emulsion or dispersion liquid is sprayed into a dry atmosphere to thereby completely evaporate off the organic solvent contained in oil droplets in the emulsion or dispersion liquid. The organic solvent removing step results in forming toner particles.

—Heating Step—

The heating step is not particularly limited and may be appropriately selected depending on the intended purpose, so long as it is a step of heating the desolventized slurry. Examples thereof include (1) a method for heating in a resting state and (2) a method for heating under stirring. The heating step results in forming toner particles each having a smooth surface. When the toner particles are dispersed in ion-exchanged water, the heating step may be performed before or after washing.

A heating temperature is not particularly limited and may be appropriately selected depending on the intended purpose, but is preferably a temperature which is higher than the glass transition temperature of various resins used in producing toner.

The heating step allows the acryl resin particles to be tightly fixed on the surface of the toner particles.

—Other Steps—

Examples of the other steps include a washing step and a drying step.

—Washing Step—

The washing step is not particularly limited and may be appropriately selected depending on the intended purpose, so long as it is a step of washing the desolventized slurry with water after the organic solvent removing step and before the heating step. Example of water includes ion-exchanged water.

—Drying Step—

The drying step is not particularly limited and may be appropriately selected depending on the intended purpose, so long as it is a step of drying the toner particles obtained from the heating step.

In the yellow toner producing method, the non-crystalline resin is preferably polyester resin because it is incompatible with the acryl resin particles. In the emulsion or dispersion liquid preparing step, the organic solvent is present within the liquid droplets of the toner material when the acryl resin particles are added before or after emulsification or dispersion. Accordingly, disadvantageously, the acryl resin particles may adhere to the surface of the liquid droplets and thereafter dissolved into the liquid droplets. When a resin component constituting the toner is polyester resin and the acryl resin particles are particles of cross-linked resin including acrylic acid ester polymer or methacrylic acid ester polymer, the compatibility between the polyester resin and the cross-linked resin is so poor that the acryl resin particles are not compatible with the liquid droplets of the toner material and exist in a state of adhering to the liquid droplets. Accordingly, the acryl resin particles penetrate the liquid droplets from the surface thereof to some extent and, after removing the organic solvent, the acryl resin particles are adhered and fixed onto the surface of the toner particles, resulting in toner particles having a desired form.

The toner produced by the above-described yellow toner producing method is a toner in which the acryl resin particles adhere onto each surface of toner particles which are formed with, as a core, a toner material mainly containing the non-crystalline resin, the crystalline resin and the C.I. Pigment Yellow 185 to thereby form the core-shell structure, and the styrene/acryl resin particles surround the outside of the core-shell structure. However, the styrene/acryl resin particles are small in the volume average particle diameter, and therefore the styrene/acryl resin particles may be embedded in the toner particle or penetrate between the toner particle and the acryl resin particles. Accordingly, it may be seen as if the acryl resin particles adhere to the surface of the toner particles unless observed in very detail for fine portions. Notably, the volume average particle diameter of the toner particles is adjusted by varying emulsifying or dispersing conditions, such as a stirring condition of the aqueous medium in the emulsion or dispersion liquid preparing step. Moreover, their acid values preferably meet the following relationship: styrene/acryl resin particles>non-crystalline resin and crystalline resin>acryl resin particles.

The anionic styrene/acryl resin particles are adhered to, and fused to and integrated with the surface of the toner particle to thereby form a relatively hard surface, which can prevent the adhered and fixed acryl resin particles from being embedded or moving through mechanical stress. The styrene/acryl resin particles can be adsorbed on the liquid droplet containing the toner material due to their anionic property to thereby prevent the liquid droplets from coalescing with each other, which is important for controlling a particle diameter distribution of the toner particles. Further, the styrene/acryl resin particles can impart negative chargeability to the toner particles. In order to attain these effects, the styrene/acryl resin particles preferably are smaller than acryl resin particles and have the volume average particle diameter of 5 nm to 50 nm.

(Color Image Forming Method)

The color image forming method of the present invention includes at least a latent electrostatic image forming step, a developing step, a transfer step and a fixing step; and, if necessary, further includes other steps such as a charge-eliminating step, a cleaning step, a recycling step and a controlling step.

The image forming apparatus of the present invention includes at least a latent electrostatic image bearing member, a latent electrostatic image forming unit, a developing unit, a transfer unit and a fixing unit; and, if necessary, further includes other units such as a charge-eliminating unit, a cleaning unit, a recycling unit and a controlling unit.

The color image forming method of the present invention can be suitably performed with the image forming apparatus of the present invention. Specifically, the latent electrostatic image forming step can be performed with the latent electrostatic image forming unit. The developing step can be performed with the developing unit. The transfer step can be performed with the transfer unit. The fixing step can be performed with the fixing unit. The other steps can be performed with the other units.

The developing step is performed using at least the yellow toner of the present invention.

A transferred image formed with the yellow toner is disposed on the uppermost surface of the transferred image transferred onto the recording medium.

<Latent Electrostatic Image Forming Step and Latent Electrostatic Image Forming Unit>

The latent electrostatic image forming step is a step of forming a latent electrostatic image on the latent electrostatic image bearing member.

For example, the material, shape, structure or size of the latent electrostatic image bearing member (hereinafter may be referred to as "photoconductor" or "photoconductor drum") is not particularly limited and may be appropriately selected from those known in the art. Example of the shape suitably includes a drum-like shape. Examples of the material include an inorganic photoconductor made of, for example, amorphous silicon or selenium and an organic photoconductor made of, for example, polysilane or phthalopolymethine. Among them, an amorphous silicon photoconductor is preferred due to its long service life.

The amorphous silicon photoconductor may be, for example, a photoconductor having a support and a photoconductive layer of a-Si, which is formed on the support heated to 50° C. to 400° C. with a film forming method such as vacuum vapor deposition, sputtering, ion plating, thermal CVD, photo-CVD or plasma CVD (hereinafter this photoconductor may be referred to as "a-Si photoconductor"). Among them, plasma CVD is suitably employed, in which gaseous raw materials are decomposed through application of direct current or high-frequency or microwave glow discharge to thereby form an a-Si deposition film on the support.

The latent electrostatic image can be formed using the latent electrostatic image forming unit by charging a surface of the photoconductor and imagewise-exposing the charged surface.

The latent electrostatic image forming unit has a charging unit configured to charge the surface of the photoconductor and an exposing unit configured to imagewise-expose the charged surface.

—Charging Unit—

The charging can be performed by, for example, applying voltage to the surface of the photoconductor using the charging unit.

The charging unit is not particularly limited and may be appropriately selected depending on the intended purpose. Examples thereof include contact-type chargers known per se having, for example, an electroconductive or semielectroconductive roller, brush, film and rubber blade; and non-contact-type chargers utilizing colona discharge such as corotron or scorotron.

The charging unit may have any shape such as a charging roller, a magnetic brush or a fur brush. The shape thereof may be suitably selected according to the specification or configuration of the color image forming apparatus.

When the magnetic brush is used as the charging unit, the magnetic brush is composed of a charging means of various ferrite particles such as Zn—Cu ferrite, a non-magnetic electroconductive sleeve configured to support the ferrite particles, and a magnetic roller included in the non-magnetic electroconductive sleeve.

Also, when the fur brush is used as the charging unit, the fur brush may be those in which a fur is subjected to electroconductive treatment with, for example, carbon, copper sulfide, a metal or a metal oxide, followed by being coiled around or mounted to a metal or other electroconductive-treated core.

The charging unit is not limited to the aforementioned contact-type charging units. However, the contact-type charging units are preferably used from the viewpoint of producing a color image forming apparatus in which the amount of ozone generated from the charging unit is reduced.

—Exposing Unit—

The exposing can be performed by, for example, imagewise exposing the photoconductor surface using the exposing unit.

The exposing unit is not particularly limited and may be appropriately selected depending on the intended purpose, so long as it attains desired imagewise exposure on the surface of the photoconductor charged with the charging unit. Examples of the exposing unit include various exposing units such as a copy optical exposing unit, a rod lens array exposing unit, a laser optical exposing unit and a liquid crystal shutter exposing unit.

A light source used for the exposing unit is not particularly limited and may be appropriately selected depending on the intended purpose. Examples thereof include usual light-emitting devices such as a fluorescent lamp, a tungsten lamp, a halogen lamp, a mercury lamp, a sodium lamp, a light-emitting diode (LED), a laser diode (LD) and an electroluminescence (EL) device.

Also, a filter may be used for emitting only light having a desired wavelength region. Examples of the filter include various filters such as a sharp-cut filter, a band-pass filter, an infrared cut filter, a dichroic filter, an interference filter and a color conversion filter.

Notably, in the present invention, a back-exposure method may be employed in which an imagewise-exposure is performed from the back side of the photoconductor.

<Developing Step and Developing Unit>

The developing step is a step of developing the latent electrostatic image with a toner to thereby form a visible image.

The developing step is performed using at least the yellow toner of the present invention.

The visible image can be formed with the developing unit by, for example, developing the latent electrostatic image using the toner.

The developing unit is not particularly limited and may be appropriately selected from known developing units, so long as it can perform developing with the toner. Example of preferred developing unit includes those including at least a developing device which contains the toner or developer therein and can apply the toner to the latent electrostatic image in a contact or non-contact manner.

The above developing device may employ a dry or wet developing process, and may be a single-color or multi-color developing device. Example of preferred developing device includes those having a rotatable magnetic roller and a stirrer configured to charge the toner or developer with friction stirring.

In the developing device, toner particles and carrier particles are stirred and mixed, so that the toner particles are charged by friction generated therebetween. The charged toner particles are retained in the chain-like form on the surface of the rotating magnetic roller to thereby form a magnetic brush. The magnetic roller is disposed proximately to the photoconductor and thus, some of the toner particles forming the magnetic brush on the surface of the magnet roller are electrically transferred onto the photoconductor surface. As a result, the latent electrostatic image is developed with the toner particles to thereby form a visual toner image on the photoconductor surface.

<Transfer Step and Transfer Unit>

The transfer step is a step of transferring the visible image onto the recording medium. In a preferred embodiment, visible images are primarily transferred onto an intermediate transfer medium, from which the visible image is secondarily transferred onto the recording medium.

The transfer can be performed by, for example, charging the photoconductor using a transfer charger, and can be performed by the transfer unit. The transfer unit preferably has a primary transfer unit configured to transfer visible images onto an intermediate transfer medium to thereby form a composite transferred image, and a secondary transfer unit configured to transfer the composite transferred image onto a recording medium.

Here, when the image to be secondary transferred onto the recording medium is a color image of a plurality of color toners including the yellow toner, in one employable configuration, the transfer unit superposes the color toner images on top of another on the intermediate transfer medium to thereby form an image on the intermediate transfer medium, and the image on the intermediate transfer medium is secondarily transferred at one time onto the recording medium by an intermediate transfer unit.

In this step, among the plurality of color toners, the yellow toner is firstly developed in order to prevent the toners from being reverse-transferred to thereby contaminate a developing unit.

Among the plurality of color toners, the toners other than the yellow toner (a cyan toner, a magenta toner and a black toner) are not particularly limited and may be appropriately selected depending on the intended purpose. However, amounts of the crystalline resin and/or releasing agent contained in the cyan toner is preferably no greater than corresponding amounts of the crystalline resin and/or releasing agent contained in the yellow toner from the viewpoint of being excellent in color reproducibility in a green image because, in this case, the yellow toner spreads more widely over the image than the cyan toner Notably, the intermediate transfer medium is not particularly limited and may be appropriately selected from known transfer media depending on the intended purpose. Preferred example thereof includes a transfer belt.

The transfer unit (the primary transfer unit and the secondary transfer unit) preferably has at least a transfer device which transfers the visible images formed on the photoconductor onto the recording medium through charging. The number of the transfer units may be one or more. Examples of the transfer device include a corona transfer device using corona discharge, a transfer belt, a transfer roller, a press transfer roller and an adhesion transfer device.

Notably, the recording medium is typically plane paper, but it is not particularly limited and may be appropriately selected depending on the intended purpose, so long as it can receive an unfixed image after developing. Example thereof includes PET bases for OHP.

In the color image forming method, the transferred image formed with the yellow toner is on the uppermost surface in the transferred image transferred onto the recording medium.

<Fixing Step and Fixing Unit>

The fixing step is a step of fixing the visible image transferred on the recording medium. In this step, fixing may be performed every time when an image of each color toner is transferred onto the recording medium, or at one time (at the same time) on a laminated image of color toners.

The fixing step is performed using the fixing unit.

The fixing unit is not particularly limited and may be appropriately selected depending on the intended purpose, but preferably is known heating and pressurizing unit. Examples of the heating and pressurizing unit include a combination of a heating roller and a pressurizing roller, and a combination of a heating roller, a pressurizing roller, and an endless belt.

Usually, a heating at the heating and pressurizing unit is preferably performed at 80° C. to 200° C.

Notably, in the present invention, for example, a known photofixing unit may be used together with or instead of the fixing unit depending on the intended purpose.

<Other Steps and Other Units>

—Charge-Eliminating Step and Charge-Eliminating Unit—

The charge-eliminating step is a step of charge-eliminating the photoconductor by applying charge-eliminating bias thereto, and can be suitably performed with a charge-eliminating unit.

The charge-eliminating unit is not particularly limited and may be appropriately selected from known charge-eliminating devices, so long as it can apply charge-eliminating bias to the photoconductor. Preferred example thereof includes a charge-eliminating lamp.

—Cleaning Step and Cleaning Unit—

The cleaning step is a step of removing the toner remaining on the photoconductor, and can be suitably performed with a cleaning unit. Notably, instead of the cleaning unit, a sliding member may be used to make the residual toner to have the same charge and the thus-treated toner may be recovered by a developing roller.

The cleaning unit is not particularly limited and may be appropriately selected from known cleaners, so long as it can remove the toner remaining on the photoconductor. Preferred examples thereof include a magnetic brush cleaner, an electrostatic brush cleaner, a magnetic roller cleaner, a blade cleaner, a brush cleaner and a web cleaner.

—Recycling Step and Recycling Unit—

The recycling step is a step of recycling the toner removed at the cleaning step to the developing unit, and can be suitably performed with a recycling unit. The recycling unit is not particularly limited and may be a known conveying unit.

—Controlling Step and Controlling Unit—

The controlling step is a step of controlling each of the above steps, and can be suitably performed with a controlling unit.

The controlling unit is not particularly limited and may be appropriately selected depending on the intended purpose, so long as it can control the operation of each unit. Examples thereof include devices such as a sequencer and a computer.

In the color image forming method, when a green image is formed by forming an image with a cyan toner on glossy paper at a toner adhesion amount of 0.30 mg/cm$^2$ and by forming an image with the yellow toner at a toner adhesion amount of 0.30 mg/cm$^2$ on the image formed with the cyan toner, the resultant green image has preferably L* of 47 to 51, a* of −71 or less (preferably −71 to −80), and b* of 20 to 30 in CIE Lab color space from the viewpoint of being excellent in color reproducibility in the green image.

Example of the glossy paper includes POD GLOSSCOAT (product of Oji paper Co., Ltd., basis weight: 158 g/m$^2$, paper thickness: 175 μm, brightness: 80% or more)

The CIE Lab can be measured X-RITE 938 (product of X-rite Inc.), for example, under the following conditions.

Light source: D50

Photometry: light reception 0°, lighting 45°

Colorimetry: view angle 2°

Measuring 10 sheets of glossy paper laminated with each other

An aspect of the image forming apparatus used in the color image forming method of the present invention will be described with reference to FIG. 1. An image forming apparatus 100 shown in FIG. 1 is equipped with a photoconductor drum 10 (hereafter may be referred to as "photoconductor 10") as the latent electrostatic image bearing member, a charge roller 20 as the charging unit, an exposure device 30 as the exposing unit, a developing device 40 as the developing unit, an intermediate transfer member 50, a cleaning device 60 as the cleaning means having a cleaning blade, and a charge-eliminating lamp 70 as a charge-eliminating unit.

The intermediate transfer member 50 is an endless belt being extended over three rollers 51 placed inside the belt and designed to be moveable in arrow direction. Some of the three rollers 51 also function as a transfer bias roller capable of applying a specified transfer bias (primary transfer bias) to the intermediate transfer member 50. The cleaning device 90 having the cleaning blade is placed near the intermediate transfer member 50, and a transfer roller 80, as the transfer unit capable of applying a transfer bias for transferring (secondary transferring) a developed image (toner image) onto transfer paper 95 which is an end recording medium, is placed face to face with the intermediate transfer member 50. In the surrounding area of the intermediate transfer member 50, a corona charger 58 configured to supply electrical charges to the toner image on the intermediate transfer member 50 is placed between a contact area of the photoconductor 10 and the intermediate transfer member 50, and a contact area of the intermediate transfer member 50 and the transfer paper 95 in the rotational direction of the intermediate transfer member 50.

The developing device 40 is constructed with a developing belt 41 as a developer carrier, a black developing device 45K, yellow developing device 45Y, magenta developing device 45M and cyan developing device 45C disposed together in a surrounding area of the developing belt 41. The black developing device 45K is equipped with a developer container 42K, a developer feeding roller 43K, and a developing roller 44K. The yellow developing device 45Y is equipped with a developer container 42Y, a developer feeding roller 43Y, and a developing roller 44Y. The magenta developing device 45M is equipped with a developer container 42M, a developer feeding roller 43M, and a developing roller 44M. The cyan developing device 45C is equipped with a developer container 42C, a developer feeding roller 43C, and a developing roller 44C. The developing belt 41 is an endless belt and is extended between several belt rollers as rotatable, and a part of the developing belt 41 is in contact with the photoconductor 10.

For example, the charge roller 20 charges the photoconductor 10 evenly in the image forming apparatus 100 shown in FIG. 1. The exposure device 30 imagewise-exposes the photoconductor 10 to thereby form a latent electrostatic image. The latent electrostatic image formed on the photoconductor drum 10 is then developed with the toner fed from the developing device 40 to thereby form a toner image. The toner image is then transferred (primary transferred) onto the intermediate transfer member 50 by a voltage applied from the roller 51 and is transferred (secondary transferred) onto the transfer paper 95. As a result, a transfer image is formed on the transfer paper 95. The residual toner on the photoconductor 10 is removed by the cleaning device 60 and the charge built up over the photoconductor 10 is temporarily removed by the charge-eliminating lamp 70.

Figure 2:
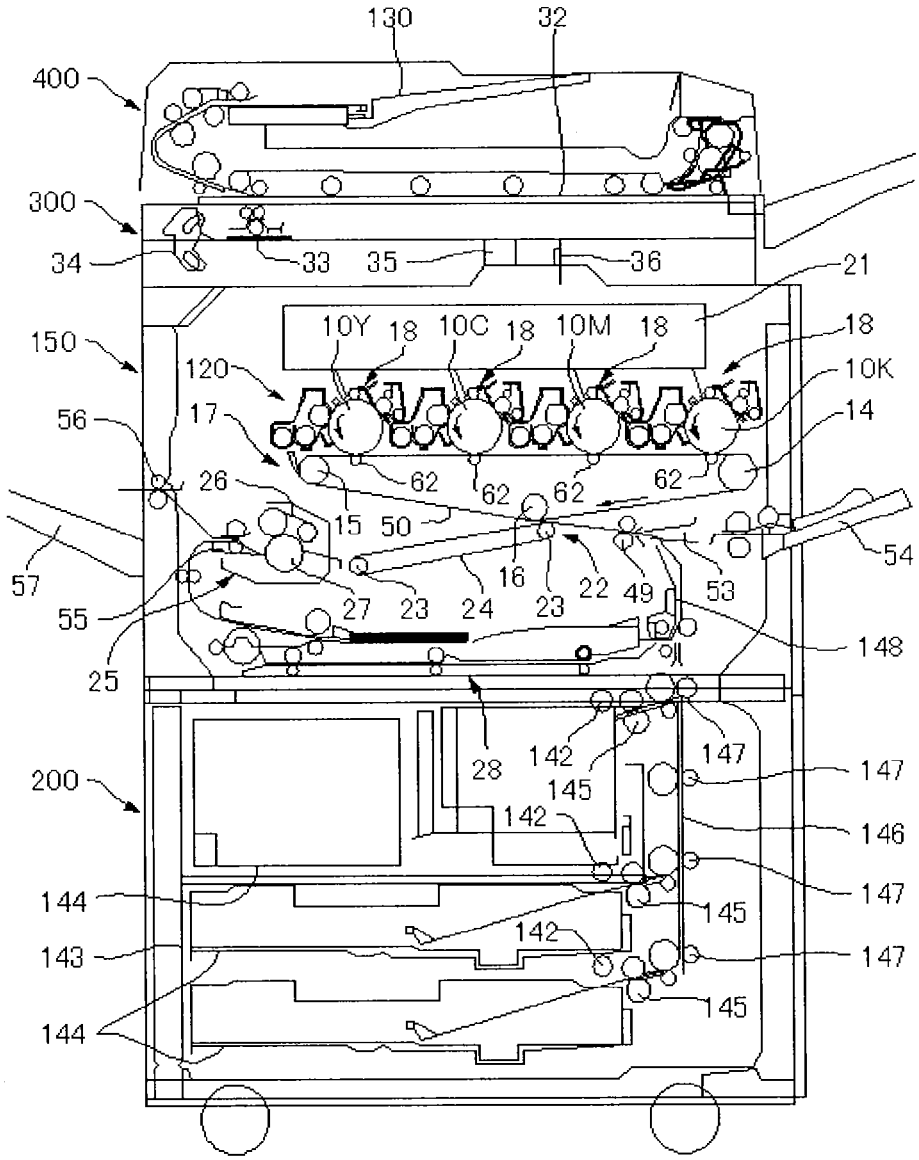
FIG. 2 is an explanatory, schematic view of another exemplary image forming apparatus used in a color image forming method according to the present invention.

A color image-forming apparatus shown in FIG. 2 includes a copying machine main body 150, a paper feeder table 200, a scanner 300, and an automatic document feeder (ADF) 400.

The copying machine main body 150 contains an endless-belt intermediate transfer member 50 in the central part thereof. The intermediate transfer member 50 is extended over support rollers 14, 15, and 16, and is configured to rotate in a clockwise direction in FIG. 2. A cleaning device 17 configured to remove the residual toner on the intermediate transfer member 50 is disposed near the support roller 15. Above the intermediate transfer member 50 extended over the support rollers 14 and 15, four image-forming units 18 of yellow, cyan, magenta, and black are arrayed in parallel in a conveyance direction of the intermediate transfer member 50 to thereby constitute a tandem developing device 120. There is also disposed an exposing device 21 adjacent to the tandem developing device 120. A secondary transfer device 22 is disposed on the opposite side of the intermediate transfer member 50 to where the tandem developing device 120 is disposed. The secondary transfer device 22 includes a secondary transferring belt 24 of an endless belt, which is extended over a pair of rollers 23. The secondary transfer device 22 is configured so that the transfer paper conveyed on the secondary transferring belt 24 can contact with the intermediate transfer member 50. Adjacent to the secondary transfer device 22, there is disposed a fixing device 25. The fixing device 25 includes a fixing belt 26 which is an endless belt, and a pressurizing roller 27 which is disposed so as to contact against the fixing belt 26.

Notably, in a tandem image-forming apparatus, a sheet reverser 28 is disposed adjacent to the secondary transfer device 22 and the fixing device 25. The sheet reverser 28 is configured to reverse the transfer sheet in order to form images on the both sides of the transfer sheet.

Full-color image (color copy) is formed by means of the tandem developing device 120 in the following manner. Initially, a document is placed on a document platen 130 of the automatic document feeder (ADF) 400. Alternatively, the automatic document feeder 400 is opened, the document is placed on a contact glass 32 of the scanner 300, and the automatic document feeder 400 is closed to press the document.

At the time of pushing a start switch (not shown), the document placed on the automatic document feeder 400 is transported onto the contact glass 32. In the case where the document is initially placed on the contact glass 32, the scanner 300 is immediately driven to thereby operate a first carriage 33 and a second carriage 34. Light is applied from a light source of the first carriage 33 to the document, and reflected light from the document is further reflected toward the second carriage 34. The reflected light is further reflected by a mirror of the second carriage 34 and passes through an image-forming lens 35 into a read sensor 36 to thereby read the color document (color image). The read color image is interrupted to image information of black, yellow, magenta and cyan.

Figure 3:
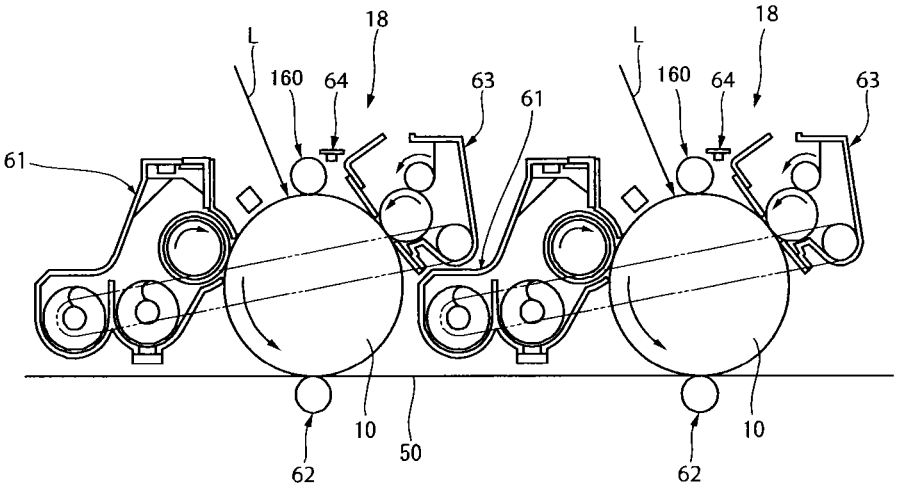
FIG. 3 is a partially enlarged view of the image forming apparatus of FIG. 2.

Each of black, yellow, magenta, and cyan image information is transmitted to respective image-forming units 18 (a black image-forming unit, a yellow image-forming unit, a magenta image-forming unit, and a cyan image-forming unit) of the tandem developing device 120, and then toner images of black, yellow, magenta, and cyan are separately formed in each image-forming unit 18. With respect to each of the image-forming units 18 (the black image-forming unit, the yellow image-forming unit, the magenta image-forming unit, and the cyan image-forming unit) of the tandem developing device 120, as shown in FIG. 3, there are disposed a photoconductor 10 (a photoconductor for black 10K, a photoconductor for yellow 10Y, a photoconductor for magenta 10M, and a photoconductor for cyan 10C), a charging device 160 which evenly charges the photoconductor 10, an exposing device which exposes (L in FIG. 3) the photoconductor 10 based on each color image information to thereby form a latent electrostatic image corresponding to each color image on the photoconductor 10, a developing unit 61 which develops the latent electrostatic image with the corresponding color toner (a black toner, a yellow toner, a magenta toner, and a cyan toner) to thereby form a toner image of each color, a transfer charger 62 for transferring the toner image to the intermediate transfer member 50, a cleaning device 63, and a charge-eliminating device 64. Accordingly, each monochrome image (a black image, a yellow image, a magenta image, and a cyan image) can be formed based on the corresponding color image information. Thus obtained black toner image formed on the photoconductor for black 10K, yellow toner image formed on the photoconductor for yellow 10Y, magenta toner image formed on the photoconductor for magenta 10M, and cyan toner image formed on the photoconductor for cyan 10C are sequentially transferred (primary transferred) onto the intermediate transfer member 50 which is rotated by means of the support rollers 14, 15 and 16. These toner images are superposed on the intermediate transfer member 50 to form a composite color image (color transferred image).

In the image forming method, among each monochrome image, the yellow image is firstly developed and transferred to the intermediate transfer medium.

One of feeding rollers 142 of the feeder table 200 is selectively rotated, sheets (recording papers) are ejected from one of multiple feeder cassettes 144 in a paper bank 143, are separated by a separation roller 145 one by one into a feeder path 146, are transported by a transport roller 147 into a feeder path 148 in the copying machine main body 150, and are bumped against a registration roller 49. Alternatively, one of the feeding rollers 142 is rotated to eject sheets (recording papers) from a manual-feeding tray 54, and the sheets are separated by a separation roller 145 one by one into a feeder path 53, transported one by one and then bumped against the registration roller 49. Notably, the registration roller 49 is generally earthed, but it may be biased for removing paper dust of the sheets. The registration roller 49 is rotated synchronously with the movement of the composite color image (color transferred image) on the intermediate transfer member 50 to transport the sheet (recording paper) into between the intermediate transfer member 50 and the secondary transferring unit 22, and the composite color image (color transferred image) is transferred (secondary transferred) onto the sheet (recording paper) by action of the secondary transferring unit 22. After transferring the composite toner image, the residual toner on the intermediate transfer member 50 is cleaned by means of the cleaning device 17 for intermediate transfer member.

In the color image forming method, the yellow toner image is disposed on the uppermost surface of the transferred image transferred on the recording medium.

The sheet (recording paper) onto which the color image has been transferred is transported by the secondary transferring unit 22 into the fixing device 25, is applied with heat and pressure in the fixing device 25 to thereby fix the composite color image (color transferred image) on the sheet (recording paper). Thereafter, the sheet (recording paper) changes its direction by action of a switch blade 55, is ejected by an ejecting roller 56 and is stacked on an output tray 57. Alternatively, the sheet changes its direction by action of the switch blade 55 into the sheet reverser 28, turns the direction, is transported again to the transfer position, subjected to an image formation on the back surface thereof. The sheet bearing images on both sides thereof is then ejected with assistance of the ejecting roller 56, and is stacked on the output tray 57.

EXAMPLES

The present invention now will be described in detail by way of Examples, which should not be construed as limiting the present invention thereto. Unless otherwise specified, the unit "part(s)" means "part(s) by mass" and the unit "%" means "% by mass."

Production Example 1-1

<Synthesis of Non-Crystalline Resin (Non-Crystalline Polyester Resin) A1>

A reaction container equipped with a stirrer and a nitrogen-introducing pipe was charged with bisphenol A ethylene oxide 2 mole adduct (66 parts), propyleneglycol (2 parts), isophthalic acid (7 parts), and adipic acid (23 parts). The resultant mixture was allowed to react under pressure at 230° C. for 5 hours and further react under a reduced pressure of 1 mmHg to 10 mmHg for 5 hours to thereby obtain a non-crystalline polyester resin. Then, trimellitic acid (2.4 parts) was added to the reaction container, followed by reacting at 240° C. for 1 hour and adjusting an acid value of the polyester resin, to thereby produce [non-crystalline polyester resin (non-crystalline resin A1)].

The resultant [non-crystalline resin A1] was found to have the number average molecular weight (Mn) of 5,100, the weight average molecular weight (Mw) of 16,000, and the glass transition temperature (Tg) of 29° C.

Production Examples 1-2 to 1-6

<Synthesis of Non-Crystalline Resins (Non-Crystalline Polyester Resins) A2 to A6>

[Non-crystalline polyester resin A2 to A6] was produced in the same manner as in Production Example 1-1, except that the type and amount of monomers were changed to the corresponding type and amount of monomers shown in Table 1, respectively.

The number average molecular weight (Mn), the weight average molecular weight (Mw), and the glass transition temperature (Tg) of the resultant resin are shown in Table 1.

TABLE 1

| | Pro. Ex. 1-1 | Pro. Ex. 1-2 | Pro. Ex. 1-3 | Pro. Ex. 1-4 | Pro. Ex. 1-5 | Pro. Ex. 1-6 |
|---|---|---|---|---|---|---|
| Non-crystalline resin | A1 | A2 | A3 | A4 | A5 | A6 |
| Bisphenol A ethylene oxide 2 mole adduct (parts by mass) | 66 | 66 | 66 | 66 | 70 | 62 |
| Propyleneglycol (parts by mass) | 2 | 2 | 2 | 2 | 2 | 2 |
| Isophthalic acid (parts by mass) | 7 | 10 | 0 | 13 | 0 | 0 |
| Adipic acid (parts by mass) | 23 | 23 | 23 | 23 | 23 | 23 |
| Trimellitic acid (parts by mass) | 2.4 | 2.4 | 2.4 | 2.4 | 2.4 | 2.4 |
| Mn | 5,100 | 5,100 | 4,900 | 5,300 | 2,500 | 22,000 |
| Mw | 16,000 | 16,000 | 17,000 | 16,000 | 8,000 | 150,000 |
| Tg (° C.) | 29 | 20 | 38 | 17 | 12 | 28 |

Production Example 2

<Synthesis of Crystalline Resin B1>

A four-neck flask equipped with a nitrogen-introducing pipe, a drainpipe, a stirrer and a thermocouple was charged with 1,10-decanedicarboxylic acid (28 parts), 1,8-octanediol (21 parts), 1,4-butanediol (51 parts) and hydroquinone (0.1 parts), followed by reacting at 180° C. for 10 hours. Thereafter, the reaction mixture was heated to 200° C., followed by reacting for 3 hours and further reacting at 8.3 kPa for 2 hours, to thereby produce [crystalline resin B1].

Through GPC measurement of soluble matter of the resultant [crystalline resin B1] in o-dichlorobenzene, the weight average molecular weight (Mw) was found to be 15,000, the number average molecular weight (Mn) was found to be 5,000, the Mw/Mn was found to be 3.0, and the melting point was found to be 67° C.

Production Example 3-1

<Preparation of Yellow Masterbatch (MB1)>

Water (500 parts), Yellow Pigment PY185 (product of BASF Japan Ltd.) (400 parts), [non-crystalline resin A3] (600 parts) and a carnauba wax (12 parts) were mixed together with HENSCHEL MIXER (product of Mitsui Mining Co.). The resultant mixture was kneaded at 150° C. for 30 min with a two-roller mill, roll-cooled, and then pulverized with the pulverizer (product of Hosokawa Micron Corporation), to thereby prepare [yellow masterbatch (MB1)].

Production Examples 3-2 to 3-4

<Preparation of Masterbatchs (MB2 to MB4)>

[Yellow masterbatch (MB2)], [yellow masterbatch (MB3)], and [cyan masterbatch (MB4)] were prepared in the same manner as in Production Example 3-1, except that the type and amount of pigments were changed to the corresponding type and amount of pigments shown in Table 2, respectively.

TABLE 2

| Masterbatch | Pro. Ex. 3-1 MB1 | Pro. Ex. 3-2 MB2 | Pro. Ex. 3-3 MB3 | Pro. Ex. 3-4 MB4 |
|---|---|---|---|---|
| Water (parts by mass) | 500 | 500 | 500 | 500 |
| PY185 (parts by mass) | 400 | 0 | 300 | 0 |
| PY74 (parts by mass) | 0 | 400 | 100 | 0 |
| PB15:3 (parts by mass) | 0 | 0 | 0 | 400 |

TABLE 2-continued

| Masterbatch | Pro. Ex. 3-1 MB1 | Pro. Ex. 3-2 MB2 | Pro. Ex. 3-3 MB3 | Pro. Ex. 3-4 MB4 |
|---|---|---|---|---|
| Non-crystalline resin A3 (parts by mass) | 600 | 600 | 600 | 600 |
| Carnauba wax (parts by mass) | 12 | 12 | 12 | 12 |

In Table 2, PY185 denotes C.I. Pigment Yellow 185 (product of BASF Japan Ltd.), PY74 denotes C.I. Pigment Yellow 74 (product of TOYO INK CO., LTD.), and PB15:3 denote C.I. Pigment Blue 15:3 (product of TOYO INK CO., LTD.).

Production Example 4

<Preparation of Styrene/Acryl Resin Particles>

A reaction container equipped with a stirring bar and a thermometer was charged with water (683 parts), a sodium salt of a sulfate ester of methacrylic acid ethylene oxide adducts (ELEMINOL RS-30, product of Sanyo Chemical Industries, Ltd.) (16 parts), styrene (83 parts), methacrylic acid (83 parts), n-butyl acrylate (110 parts) and ammonium persulfate (1 part). The resultant mixture was stirred at 400 rpm for 15 min, resulting in a white emulsion. The white emulsion was then heated to 75° C. of an inside system temperature, followed by reacting for 5 hours. Next, 1% aqueous ammonium persulfate solution (30 parts) was added thereto, and aged at 75° C. for 5 hours to thereby obtain an aqueous dispersion liquid of a vinyl resin (copolymer of styrene-methacrylic acid-sodium salt of a sulfate ester of methacrylic acid ethylene oxide adduct) [styrene/acryl resin particle dispersion liquid]. The [styrene/acryl resin particle dispersion liquid] was found to have the volume average particle diameter of 14 nm through measurement with LA-920 (product of HORIBA Co.), the acid value of 45 mgKOH/g, the weight average molecular weight (Mw) of 300,000, and the glass transition temperature (Tg) of 60° C.

Production Example 5-1

<Preparation of Acryl Resin Particles C1>

A reaction container equipped with a stirring bar and a thermometer was charged with water (683 parts), distearyldimethylammonium chloride (CATION DS, product of Kao Corporation) (10 parts), methyl methacrylate (176 parts), n-butyl acrylate (18 parts), ammonium persulfate (1 part), and ethyleneglycol dimethacrylate (2 parts). The resultant mixture was stirred at 400 rpm for 15 min to obtain a white emulsion. The white emulsion was then heated to 65° C. of an inside system temperature, followed by reacting for 10 hours.

Next, 1% aqueous ammonium persulfate solution (30 parts) was added thereto and aged at 75° C. for 5 hours, to thereby obtain an aqueous dispersion liquid of a vinyl resin (methyl methacrylate) [acryl resin particle dispersion liquid C1 (aqueous dispersion liquid of acryl resin particles)]. The [acryl resin particle dispersion liquid C1] was found to have the volume average particle diameter of 35 nm through measurement with LA-920 (product of HORIBA Co.), the acid value of 2 mgKOH/g, the weight average molecular weight (Mw) of 30,000, and the glass transition temperature (Tg) of 82° C.

Production Examples 5-2 to 5-6

<Synthesis of Acryl Resin Particles C2 to C6>

[Acryl resin particles C2 to C6] was produced in the same manner as in Production Example 5-1, except that the type and amount of monomers were changed to the corresponding type and amount of monomers shown in Table 3, respectively.

The volume average particle diameter, the acid value, the weight average molecular weight (Mw), and the glass transition temperature (Tg) of the resultant acryl resin particles are shown in Table 3.

TABLE 3

| | Pro. Ex. 5-1 | Pro. Ex. 5-2 | Pro. Ex. 5-3 | Pro. Ex. 5-4 | Pro. Ex. 5-5 | Pro. Ex. 5-6 |
|---|---|---|---|---|---|---|
| Acryl resin particles | C1 | C2 | C3 | C4 | C5 | C6 |
| Water (part by mass) | 683 | 683 | 683 | 683 | 683 | 683 |
| Distearyldimethylammonium chloride (part by mass) | 10 | 10 | 10 | 10 | 10 | 10 |
| Methyl methacrylate (part by mass) | 176 | 128 | 194 | 176 | 128 | 194 |
| n-butyl acrylate (part by mass) | 18 | 66 | 0 | 18 | 66 | 0 |
| Ethyleneglycol dimethacrylate (part by mass) | 2 | 2 | 2 | 0 | 0 | 0 |
| Volume average particle diameter (nm) | 35 | 40 | 30 | 55 | 50 | 60 |
| Acid value (mgKOH/g) | 2 | 3 | 2 | 1 | 3 | 2 |
| Mw | 30,000 | 35,000 | 40,000 | 25,000 | 27,000 | 21,000 |
| Tg (° C.) | 82 | 43 | 110 | 79 | 37 | 103 |

Example 1

<Production of Toner>

—Production of Releasing Agent (WAX) Dispersion Liquid—

A container equipped with a stirring bar and a thermometer was charged with the [non-crystalline resin A3] (300 parts), paraffin wax serving as a releasing agent (product of NIPPON SEIRO CO., LTD., HNP-9, hydrocarbon wax, melting point: 75° C.) (100 parts), and ethyl acetate (600 parts). The resultant mixture was heated to 80° C. under stirring, maintained at 80° C. for 5 hours and then cooled to 30° C. over 1 hour to thereby obtain [releasing agent dispersion liquid D1].

—Preparation of Aqueous Medium Phase (Aqueous Phase)—

Water (660 parts), [styrene/acryl resin particle dispersion liquid] (25 parts), 48.5% aqueous solution of sodium dodecyldiphenyl ether disulfonate (ELEMINOL MON-7, product of Sanyo Chemical Industries Ltd.) (25 parts) and ethyl acetate (60 parts) were mixed together and stirred to thereby obtain a milky-white liquid (aqueous medium phase).

—Preparation of Toner Material Phase—

The [non-crystalline resin A3] (100 parts) were stirred with ethyl acetate (114 parts) in a beaker and allowed to be dissolved therein. Then, the [releasing agent dispersion liquid D1] (60 parts), [masterbatch MB 1] (20 parts), and [crystalline resin B1] (12 parts) were added to the beaker and dispersed with a beads mill (ULTRA VISCOMILL, product of AIMEX CO., Ltd.) under the following conditions: liquid feed rate of 1 kg/hr, disc circumferential velocity of 6 m/s, 0.5 mm-zirconia beads packed in 80% by volume, and 3 passes to thereby prepare [raw material solution (toner material phase)].

—Preparation of Emulsion or Dispersion Liquid—

The aqueous medium phase (150 parts) was placed in a container and stirred at 12,000 rpm using ROBOMIX (product of Tokushu Kika Kogyo Co., Ltd.). Then, the [raw material solution (toner material phase)] (100 parts) is added thereto and mixed for 10 min to thereby prepare [emulsion or dispersion liquid (emulsified slurry)].

—Removal of Organic Solvent—

The resultant [emulsified slurry] was placed in a flask equipped with a degassing pipe, a stirrer and a thermometer. While stirring the emulsified slurry at a stirring circumferential speed of 20 m/min, organic solvent was removed out at 30° C. for 12 hours under a reduced pressure to thereby obtain [desolventized slurry].

—Washing—

The total amount of the resultant [desolventized slurry] was subjected to filtration under reduced pressure. Thereafter, ion-exchanged water (300 parts) was added to the resultant filtration cake, followed by mixing and redispersing with TK HOMOMIXER (at 12,000 rpm for 10 min) and filtrating. The following procedures were repeated for three times: ion-exchanged water (300 parts) was added to the resultant filtration cake, followed by mixing with TK HOMOMIXER (at 12,000 rpm for 10 min) and filtrating. As a result, a conductivity of the redispersed slurry fell within 0.1 μS/cm or more and 10 μS/cm or less, which was referred to as [washed slurry].

—Heat Treatment—

The resultant [washed slurry] was placed in a flask equipped with a stirrer and a thermometer. While stirring at a stirring circumferential speed of 20 m/min, the [washed slurry] was subjected to heat treatment at 50° C. for 60 min under stirring and filtration to thereby obtain [filtration cake].

—Drying—

The resultant [filtration cake] was dried with a circular wind dryer at 45° C. for 48 hr. The dried product was sieved through a sieve with 75 him-mesh opening, to thereby obtain [toner base particles].

—External Addition Treatment—

The resultant [toner base particles] (100 parts) were mixed with hydrophobic silica (average particle diameter: 100 nm, 0.6 parts), titanium oxide (average particle diameter: 20 nm, 1.0 part), and hydrophobic silica powder (average particle diameter: 15 nm, 0.8 parts) using HENSCHEL MIXER to thereby obtain a toner.

Examples 2, 3, 10, 11 and 14, and Comparative Examples 1 to 3

Toners of Examples 2, 3, 10, 11 and 14, and Comparative Examples 1 to 3 were produced in the same manner as in Example 1, except that each toner material was changed to that of shown in Tables 4-1 and 4-2, respectively, and at the preparation of toner material phase, the incorporated amount of crystalline resin was changed so that the amount of the crystalline resin contained in the resultant toner was that of shown in Tables 4-1 and 4-2.

Notably, in Examples 10 and 11, and Comparative Examples 1 and 3, the releasing agent dispersion liquid and the non-crystalline resin in the masterbatch were also changed to the non-crystalline resin shown in Tables 4-1 and 4-2.

Example 4

A toner of Example 4 having a core-shell structure was produced in the same manner as in Example 1, except that the aqueous medium phase was changed to the following aqueous medium phase, and each toner material was changed to that of shown in Tables 4-1 and 4-2.

—Preparation of Aqueous Medium Phase (Aqueous Phase)—

Water (660 parts), [styrene/acryl resin particles dispersion liquid] (25 parts), 48.5% aqueous solution of sodium dodecyldiphenyl ether disulfonate (ELEMINOL MON-7, product of Sanyo Chemical Industries Ltd.) (25 parts) and ethyl acetate (60 parts) were mixed together and stirred to thereby obtain a milky-white liquid (aqueous phase). The [acryl resin particles C4] (50 parts) was further added thereto to thereby obtain an aqueous medium phase. The aqueous medium phase contained aggregates each having a size of several hundred micrometers as observed under an optical microscope. The aqueous medium phase was stirred at 8,000 rpm with TK HOMOMIXER (product of Tokushu Kika Kogyo Co., Ltd.). As a result, the aggregates were separated and dispersed into small aggregates each having a size of several micrometers, which was confirmed with the optical microscope.

Therefore, it had been expected that the acryl resin particles were dispersed and adhered to liquid droplets of the toner material component in the subsequent emulsification step of the toner material. Accordingly, in order to allow the acryl resin particles to uniformly adhere to the toner surface, it is important that even if the acryl resin particles once aggregated with each other, the resultant aggregates can be dispersed by shearing.

Examples 5 to 9, 12 and 13

Toners of Examples 5 to 9, 12 and 13 having a core-shell structure were produced in the same manner as in Example 4, except that each toner materials were changed to that of shown in Tables 4-1 and 4-2.

Notably, in Example 12, the releasing agent dispersion liquid and the non-crystalline resin in the masterbatch were also changed to the non-crystalline resin shown in Tables 4-1 and 4-2.

Example 15

A toner of Example 15 having a core-shell structure was produced in the same manner as in Example 7, except that the amount of the [masterbatch MB1] in the toner material phase was changed to 43 parts.

Example 16

A toner of Example 16 having a core-shell structure was produced in the same manner as in Example 7, except that the amount of the [masterbatch MB1] in the toner material phase was changed to 65 parts.

A composition and property of each of the toners are shown in Tables 4-1 and 4-2.

TABLE 4-1

| | Composition and property of each of toners | | | |
|---|---|---|---|---|
| | Non-crystalline resin | Masterbatch | PY185 (parts) | PY74 (parts) |
| Ex. 1 | A3 | MB1 | 5.0 | 0 |
| Ex. 2 | A3 | MB1 | 4.6 | 0 |
| Ex. 3 | A3 | MB1 | 4.2 | 0 |
| Ex. 4 | A3 | MB1 | 4.6 | 0 |
| Ex. 5 | A3 | MB1 | 4.6 | 0 |
| Ex. 6 | A3 | MB1 | 4.6 | 0 |
| Ex. 7 | A3 | MB1 | 4.6 | 0 |
| Ex. 8 | A3 | MB1 | 4.6 | 0 |
| Ex. 9 | A3 | MB1 | 4.6 | 0 |
| Ex. 10 | A5 | MB1 | 4.6 | 0 |
| Ex. 11 | A6 | MB1 | 4.6 | 0 |
| Ex. 12 | A3 | MB3 | 3.5 | 1.1 |
| Ex. 13 | A1 | MB1 | 4.6 | 0 |
| Ex. 14 | A3 | MB1 | 5.4 | 0 |
| Ex. 15 | A3 | MB1 | 10.0 | 0 |
| Ex. 16 | A3 | MB1 | 15.0 | 0 |
| Comp. Ex. 1 | A4 | MB1 | 4.6 | 0 |
| Comp. Ex. 2 | A3 | MB1 | 4.6 | 0 |
| Comp. Ex. 3 | A2 | MB2 | 0 | 4.6 |

TABLE 4-2

| | Composition and property of each of toners | | | |
|---|---|---|---|---|
| | Amount of crystalline resin | Shell (acryl resin particles) Type | Tg (° C.) | Tg (° C.) |
| Ex. 1 | 7.5 | None | — | 26 |
| Ex. 2 | 15 | None | — | 28 |
| Ex. 3 | 22.5 | None | — | 30 |
| Ex. 4 | 15 | C4 | 79 | 30 |
| Ex. 5 | 15 | C6 | 103 | 32 |
| Ex. 6 | 15 | C5 | 37 | 29 |
| Ex. 7 | 15 | C1 | 82 | 31 |
| Ex. 8 | 15 | C3 | 110 | 33 |
| Ex. 9 | 15 | C2 | 43 | 30 |
| Ex. 10 | 15 | None | — | 20 |
| Ex. 11 | 15 | None | — | 38 |
| Ex. 12 | 15 | C1 | 82 | 30 |
| Ex. 13 | 15 | C1 | 82 | 35 |
| Ex. 14 | 0 | None | — | 25 |
| Ex. 15 | 15 | C1 | 82 | 31 |
| Ex. 16 | 15 | C1 | 82 | 31 |
| Comp. Ex. 1 | 15 | None | — | 45 |
| Comp. Ex. 2 | 15 | None | — | 15 |
| Comp. Ex. 3 | 15 | None | — | 39 |

Notably, in Tables 4-1 and 4-2, amounts of pigments (parts by mass) and crystalline resin (parts by mass) denotes amounts of pigments and crystalline resin relative to 100 parts of toner.

The glass transition temperature (Tg) of each of shells and toners in Tables 4-2 was measured as follows. Notably, the glass transition temperature of each of shells was determined by measuring that of the acryl resin particles produced.

<Measurement of Glass Transition Temperature (Tg)>

The glass transition temperature was measured with a DSC system (Differential scanning calorimeters) ("Q-200", product by TA Instruments. Japan.).

Specifically, the glass transition temperature of a measurement sample can be measured according to the following procedure.

First, an aluminum sample container was charged with a measurement sample (about 5.0 mg). The sample container is placed on a holder unit and set in an electric furnace. Next, in a nitrogen atmosphere, the sample container is heated from 0° C. to 150° C. at a temperature increasing rate of 10° C./min. In this process, the DSC curve of the sample is measured with the differential scanning calorimeter ("Q-200", product by TA Instruments. Japan.).

The glass transition temperature of the measurement sample was determined based on the DSC curve using the analysis program of the Q-200 system.

(Production of Cyan Toner 1)

Cyan toner 1 containing a crystalline resin was produced in the same manner as in Example 2, except that a toner material phase was prepared as follows.

—Preparation of Toner Material Phase—

The [non-crystalline resin A3] (100 parts) was stirred with ethyl acetate (114 parts) in a beaker and allowed to be dissolved therein. Then, [releasing agent dispersion liquid D1] (60 parts), [masterbatch MB4 (cyan masterbatch)] (10 parts), and [crystalline resin B1] (12 parts) were added to the beaker and dispersed with a beads mill (ULTRA VISCOMILL, product of AIMEX CO., Ltd.) under the following conditions: liquid feed rate of 1 kg/hr, disc circumferential velocity of 6 m/s, 0.5 mm-zirconia beads packed in 80% by volume, and 3 passes to thereby prepare [raw material solution (toner material phase)].

(Production of Cyan Toner 2)

Cyan toner 2 containing no crystalline resin was produced in the same manner as in Example 14, except that a toner material phase was prepared as follows.

—Preparation of Toner Material Phase—

The [non-crystalline resin A3] (100 parts) was stirred with ethyl acetate (114 parts) in a beaker and allowed to be dissolved therein. Then, [releasing agent dispersion liquid D1] (60 parts) and [masterbatch MB4 (cyan masterbatch)] (10 parts) were added to the beaker and dispersed with a beads mill (ULTRA VISCOMILL, product of AIMEX CO., Ltd.) under the following conditions: liquid feed rate of 1 kg/hr, disc circumferential velocity of 6 m/s, 0.5 mm-zirconia beads packed in 80% by volume, and 3 passes to thereby prepare [raw material solution (toner material phase)].

<Evaluation>

The following evaluations were performed.

<<Production of Yellow Image>>

Using a full-color multi-function printer IMAGIO NEOC600PRO (product of Ricoh Company, Ltd.), a yellow image was outputted on a whole surface of A4 size glossy paper (POD GLOSSCOAT, product of Oji paper Co., Ltd., basis weight: 158 g/m$^2$, paper thickness: 175 μm, brightness: 80% or more) while adjusting an image density at a yellow toner adhesion amount of 0.30 mg/cm$^2$. Color evaluations were performed at a total of 9 points (the left, middle, and right areas in each of the upper, middle, and lower areas, respectively) in the image on the glossy paper. The values obtained from the color evaluations were averaged. The toner adhesion amount was determined by outputting an unfixed image on paper, removing the toner from the paper with blowing compressed air, and weighing the paper before and after removing the toner to thereby calculate the change in mass thereof.

Color evaluation (colorimetry) was performed using a colorimeter (X-RITE 938, product of X-rite Inc.), for example, under the following conditions. The results are shown in Table 5.

Light source: D50

Photometry: light reception 0°, lighting 45°

Colorimetry: view angle 2°

Measuring 10 sheets of glossy paper laminated with each other

<<Heat Resistant Storage Stability>>

The toner was stored at 50° C. for 8 hours in a sealed vial (20 g), and then sieved through a 42-mesh sieve with 355 μm-mesh opening for 2 min. The amount of the toner remaining on the mesh was measured relative to the total amount of the toner (residual toner rate).

Here, the better heat resistant storage stability the toner has, the lower the residual toner rate.

Notably, the heat resistant storage stability was evaluated according to the following criteria. The results are shown in Table 5.

A: Residual toner rate<10%

B: 10%≤Residual toner rate<20%

C: 20%≤Residual toner rate<30% (lowest acceptable level in practical use)

D: 30%≤Residual toner rate (non-acceptable level in practical use)

<<Low Temperature Fixing Ability>>

Using a full-color multi-function printer IMAGIO NEOC600PRO (product of Ricoh Company, Ltd.) of which fixing part was modified to enable to adjust a temperature and linear velocity, a solid image was formed on Type 6200 paper (product of Ricoh Company, Ltd.) at a toner-adhesion amount of 0.85 mg/cm$^2$±0.01 mg/cm$^2$ and fixed. Thus obtained fixed solid image was evaluated. The fixing roller temperature at which a residual image-density rate after rubbing the fixed image with a pad was 70% or more was considered to be the lower limit fixing temperature.

The evaluation conditions for the lower limit fixing temperature were set as follows: linear velocity of paper feeding: 150 mm/sec, surface pressure: 1.2 kgf/cm$^2$ and nip width: 3 mm.

TABLE 5

| | Evaluation of yellow image | | | Heat resistant storage | Lower limit fixing |
|---|---|---|---|---|---|
| | L* | a* | b* | stability | temperature |
| Ex. 1 | 89 | −9 | 93 | A | 100 |
| Ex. 2 | 88 | −11 | 95 | B | 95 |
| Ex. 3 | 87 | −11 | 105 | C | 90 |
| Ex. 4 | 88 | −11 | 97 | B | 100 |
| Ex. 5 | 88 | −11 | 94 | A | 100 |
| Ex. 6 | 87 | −12 | 100 | C | 100 |
| Ex. 7 | 88 | −11 | 98 | A | 105 |
| Ex. 8 | 88 | −10 | 95 | A | 105 |
| Ex. 9 | 87 | −12 | 102 | B | 100 |
| Ex. 10 | 88 | −11 | 95 | C | 95 |
| Ex. 11 | 90 | −8 | 92 | B | 105 |
| Ex. 12 | 87 | −6 | 93 | B | 100 |
| Ex. 13 | 88 | −11 | 94 | B | 105 |
| Ex. 14 | 89 | −8 | 90 | C | 115 |
| Ex. 15 | 89 | −11 | 100 | A | 105 |
| Ex. 16 | 88 | −13 | 109 | A | 100 |
| Comp. Ex. 1 | 92 | −10 | 88 | B | 130 |
| Comp. Ex. 2 | 93 | −6 | 81 | D | 110 |
| Comp. Ex. 3 | 88 | −2 | 93 | D | 125 |

(Formation of Green Image)

Using a full-color multi-function printer IMAGIO NEOC600PRO (product of Ricoh Company, Ltd.), a cyan image and a yellow image were outputted in this order on a whole surface of A4 size glossy paper (POD GLOSSCOAT, product of Oji paper Co., Ltd., basis weight: 158 g/m$^2$, paper thickness: 175 μm, brightness: 80% or more) while adjusting an image density at each toner adhesion amount of 0.30 mg/cm$^2$. Color evaluations were performed at a total of 9 points (the left, middle, and right areas in each of the upper, middle, and lower areas, respectively) in the superposed image on the glossy paper. The values obtained from the color evaluations were averaged. The toner adhesion amount was determined by outputting an unfixed image on paper, removing the toner from the paper with blowing compressed air, and weighing the paper before and after removing the toner to thereby calculate the change in mass thereof.

Color evaluation (colorimetry) was performed using a colorimeter (X-RITE 938, product of X-rite Inc.), for example, under the following conditions. The results are shown in Tables 6-1 and 6-2.

Light source: D50

Photometry: light reception 0°, lighting 45°

Colorimetry: view angle 2°

Measuring 10 sheets of glossy paper laminated with each other

TABLE 6-1

| | Evaluation of green image | | | |
|---|---|---|---|---|
| | Cyan toner | L* | a* | b* |
| Ex. 1 | 1 | 49 | −78 | 24 |
| | 2 | 50 | −75 | 22 |
| Ex. 2 | 1 | 47 | −80 | 24 |
| | 2 | 48 | −73 | 22 |
| Ex. 3 | 1 | 48 | −78 | 29 |
| | 2 | 49 | −74 | 26 |
| Ex. 4 | 1 | 49 | −81 | 26 |
| | 2 | 51 | −77 | 23 |
| Ex. 5 | 1 | 50 | −76 | 24 |
| | 2 | 51 | −72 | 21 |
| Ex. 6 | 1 | 48 | −83 | 27 |
| | 2 | 48 | −80 | 24 |
| Ex. 7 | 1 | 50 | −80 | 26 |
| | 2 | 50 | −79 | 24 |
| Ex. 8 | 1 | 51 | −76 | 22 |
| | 2 | 50 | −73 | 20 |
| Ex. 9 | 1 | 47 | −83 | 28 |
| | 2 | 49 | −81 | 25 |
| Ex. 10 | 1 | 48 | −79 | 23 |
| | 2 | 47 | −72 | 21 |

TABLE 6-2

| | Evaluation of green image | | | |
|---|---|---|---|---|
| | Cyan toner | L* | a* | b* |
| Ex. 11 | 1 | 48 | −73 | 22 |
| | 2 | 49 | −72 | 21 |
| Ex. 12 | 1 | 47 | −72 | 23 |
| | 2 | 47 | −71 | 22 |
| Ex. 13 | 1 | 48 | −79 | 22 |
| | 2 | 50 | −76 | 20 |
| Ex. 14 | 1 | 51 | −72 | 22 |
| | 2 | 50 | −71 | 20 |

TABLE 6-2-continued

| | Evaluation of green image | | | |
|---|---|---|---|---|
| | Cyan toner | L* | a* | b* |
| Ex. 15 | 1 | 49 | −85 | 27 |
| | 2 | 50 | −83 | 25 |
| Ex. 16 | 1 | 48 | −88 | 29 |
| | 2 | 49 | −86 | 26 |
| Comp. Ex. 1 | 1 | 52 | −73 | 15 |
| | 2 | 56 | −70 | 13 |
| Comp. Ex. 2 | 1 | 55 | −68 | 10 |
| | 2 | 60 | −62 | 7 |
| Comp. Ex. 3 | 1 | 47 | −60 | 20 |
| | 2 | 50 | −55 | 14 |

The yellow toners of Examples 1 to 16 of the present invention were excellent in color developing property on a recording medium, especially on glossy paper which needed high color property, as well as in green color developing property when superposed on a cyan toner image.

When the yellow toners had a core-shell structure and the shell thereof had the Tg of more than 50° C. but less than 115° C., they were excellent in color developing property on a recording medium, especially on glossy paper which needed high color property, as well as in heat resistant storage stability and low temperature fixing ability.

On the other hand, the toners of Comparative Examples had undesired color property.

This application claims priority to Japanese application No. 2011-288853, filed on Dec. 28, 2011 and incorporated herein by reference.

What is claimed is:

1. A color image forming method comprising:

forming a latent electrostatic image on a latent electrostatic image bearing member;

developing the latent electrostatic image with at least a yellow toner and a cyan toner to thereby form a visible image, wherein the visible image comprises a green image;

transferring the visible image onto a recording medium; and fixing the visible image transferred onto the recording medium, wherein the visible image formed with the yellow toner and the cyan toner is on an uppermost surface of the visible image transferred onto the recording medium, wherein the yellow toner comprises:

a non-crystalline polyester resin;

a crystalline polyester resin;

C.I. Pigment Yellow 185; and a releasing agent, and wherein the yellow toner has a glass transition temperature of more than 18° C. but less than 40° C.;

wherein the green image has L* of 47 to 51, a* of −71 or less, and b* of 20 to 30 in CIE Lab color space, the green image being obtained by forming an image with the cyan toner on glossy paper at a toner adhesion amount of 0.30 mg/cm$^2$ and by forming an image with the yellow toner at a toner adhesion amount of 0.30 mg/cm$^2$ on the image formed with the cyan toner.

* * * * *